US008026891B2

(12) United States Patent
Kim et al.

(10) Patent No.: US 8,026,891 B2
(45) Date of Patent: Sep. 27, 2011

(54) FLAT PANEL DISPLAY INCLUDING TRANSCEIVER CIRCUIT FOR DIGITAL INTERFACE

(75) Inventors: Jong-Seon Kim, Pyeongtaek (KR); Jun-Hyung Souk, Yongin (KR); Myung-Ryul Choi, Seoul (KR); Seung-Woo Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 1264 days.

(21) Appl. No.: 11/450,771

(22) Filed: Jun. 9, 2006

(65) Prior Publication Data

US 2006/0227124 A1 Oct. 12, 2006

Related U.S. Application Data

(63) Continuation of application No. 10/372,042, filed on Feb. 21, 2003, now abandoned.

(30) Foreign Application Priority Data

Feb. 21, 2002 (KR) ..... 2002-9354
Nov. 28, 2002 (KR) ..... 2002-74687

(51) Int. Cl.
*G09G 3/36* (2006.01)

(52) U.S. Cl. ..... 345/100; 345/98

(58) Field of Classification Search ..... 345/55–104, 345/204; 327/103; 710/106, 206
See application file for complete search history.

(56) References Cited

U.S. PATENT DOCUMENTS 4,631,428 A 12/1986 Grimes ..... 307/475
5,166,887 A * 11/1992 Farrington et al. ..... 700/293
5,512,853 A 4/1996 Ueno et al. ..... 327/333
5,585,744 A 12/1996 Runas et al. ..... 326/86
(Continued)

FOREIGN PATENT DOCUMENTS

CA 1194574 10/1995
(Continued)

OTHER PUBLICATIONS

Kim et al.; "A Modified LVDS Interface Circuit and Coding Method for the LCD Driving System"; pp. 424-432; Aug. 2000.

*Primary Examiner* — Nitin Patel
(74) *Attorney, Agent, or Firm* — Cantor Colburn LLP

(57) ABSTRACT

The present invention relates to a digital data transceiver circuit applicable to a flat panel display such as an LCD to be placed between graphic signal generation module and liquid crystal display module or between timing control IC and data driver IC, etc. A digital data transceiver circuit of the present invention has a first current source and a second current source, and the second current source is controlled to supply a current or not depending on the status of the lower bit of input data. A transmitter is connected to a node, on which the first and second current sources combine, and the transmission paths of currents from the two current sources are determined depending on the status of the upper bit of input data. A signal of the transmitter is transmitted through a transmission line, and a termination resistor is connected to the transmission line. A receiver detects output data according to a voltage applied to the termination resistor. The digital data transceiver circuit of the present invention can transmit 2-bit or 3-bit data during one clock period, and it is resistible to the noise better than the voltage transmission method and effective to long distance transmission.

9 Claims, 24 Drawing Sheets

U.S. PATENT DOCUMENTS

| | | | | |
|---|---|---|---|---|
| 5,596,291 | A | 1/1997 | Runas | 327/108 |
| 5,757,338 | A | 5/1998 | Bassetti et al. | |
| 5,848,101 | A | 12/1998 | Taylor | 375/257 |
| 6,046,735 | A | 4/2000 | Bassetti et al. | |
| 6,448,815 | B1 | 9/2002 | Talbot et al. | 326/86 |
| 6,615,301 | B1 | 9/2003 | Lee et al. | 710/106 |
| 6,703,866 | B1 | 3/2004 | Arimilli et al. | 326/86 |
| 6,725,304 | B2 | 4/2004 | Arimilli et al. | 710/106 |
| 2003/0071799 | A1 * | 4/2003 | Myers | 345/204 |

FOREIGN PATENT DOCUMENTS

| | | |
|---|---|---|
| JP | 53-70822 | 6/1978 |
| JP | 63-193746 | 8/1988 |
| JP | 08-125672 | 5/1996 |
| JP | 10-207434 | 8/1998 |
| JP | 10-282933 | 10/1998 |
| JP | 11-065535 | 3/1999 |
| JP | 2000-353035 | 12/2000 |
| KR | 1019980060012 | 10/1998 |
| KR | 1019980075241 | 11/1998 |
| KR | 1019980083650 | 12/1998 |
| KR | 1020010016901 | 3/2001 |
| KR | 1020010089251 | 9/2001 |
| KR | 1020020007577 | 1/2002 |
| KR | 1020020011751 | 2/2002 |

* cited by examiner

| D1 | D2 | $I_R$ | $V_a-V_b$ |
|---|---|---|---|
| 0 | 0 | $-I_D$ | $2I_R \times R$ |
| 0 | 1 | $-2I_D$ | |
| 1 | 0 | $I_D$ | |
| 1 | 1 | $2I_D$ | |

| I1 | I2 | S1 | S2 | S3 | S4 | D2 | D1 |
|---|---|---|---|---|---|---|---|
| $2I_{ref}$ | $1I_{ref}$ | off | | | off | 0 | 0 |
| $1I_{ref}$ | $2I_{ref}$ | | off | off | | 0 | 1 |
| $3I_{ref}$ | $1I_{ref}$ | | | | off | 1 | 0 |
| $1I_{ref}$ | $3I_{ref}$ | | off | | | 1 | 1 |

| Input | | A | B | C | Inverter1 | AND OR | Inverter2 |
|---|---|---|---|---|---|---|---|
| D1 | D2 | | | | | | |
| 0 | 0 | H | H | H | L | H | L |
| 1 | 0 | L | H | H | L | L | H |
| 0 | 1 | L | L | H | H | H | L |
| 1 | 1 | L | L | L | H | L | H |

*FIG.15*

| Input | | | | | | | | | | output | | |
|---|---|---|---|---|---|---|---|---|---|---|---|---|
| D1 | D2 | D3 | A | B | C | D | E | F | G | D1 | D2 | D3 |
| 0 | 0 | 0 | L | L | L | L | L | L | L | 0 | 0 | 0 |
| 0 | 0 | 1 | L | L | L | L | L | L | H | 0 | 0 | 1 |
| 0 | 1 | 0 | L | L | L | L | L | H | H | 0 | 1 | 0 |
| 0 | 1 | 1 | L | L | L | L | H | H | H | 0 | 1 | 1 |
| 1 | 0 | 0 | L | L | L | H | H | H | H | 1 | 0 | 0 |
| 1 | 0 | 1 | L | L | H | H | H | H | H | 1 | 0 | 1 |
| 1 | 1 | 0 | L | H | H | H | H | H | H | 1 | 1 | 0 |
| 1 | 1 | 1 | H | H | H | H | H | H | H | 1 | 1 | 1 |

FLAT PANEL DISPLAY INCLUDING TRANSCEIVER CIRCUIT FOR DIGITAL INTERFACE

CROSS REFERENCE TO RELATED APPLICATIONS

This application is a continuation of U.S. patent application Ser. No. 10/372,042, filed on Feb. 21, 2003, now abandoned which is herein incorporated by reference in its entirety.

BACKGROUND OF THE INVENTION (a) Field of the Invention

The present invention relates to a flat panel display, and more particularly to a flat panel display including a digital data transceiver circuit for an interface between a graphic signal generation module and a display module or between a timing control integrated circuit and a data driver integrated circuit in a display module.

(b) Description of Related Art

The latest trend of the display device is that flat panel displays substitute for CRTs (cathode-ray tubes) because the latter occupy large space and consume much power. In particular, a liquid crystal display ("LCD") is spotlighted in the field of flat panel display as it becomes larger, clearer, lighter, thinner, and less power consuming.

A typical LCD requires a digital interface for data transmission between a graphic data generating module and a liquid crystal display module or between a timing control integrated circuit (IC) and a data driver IC in the liquid crystal display module. The digital interface makes it possible to directly transmit digital-processed image data without any additional data processing circuit, and therefore, it helps to achieve low-cost, low-power-consumption and high-quality display device.

In general, the data transmission using TTL/CMOS interface is used for up to SVGA class resolution. On the contrary, a digital interface such as LVDS (low voltage differential signaling), TMDS (transition minimized differential signaling), or RSDS (reduced swing differential signaling) is used for XGA or higher class to overcome technical obstacles such as timing margin, EMI (electro-magnetic interference), EMC (electro-magnetic compatibility), etc.

On the other hand, many improvements are needed for the digital interface in terms of improvement of data transmission rate, reduction of power consumption during data transmission, EMI improvement, and noise adaptability as the LCD becomes larger.

BRIEF SUMMARY OF THE INVENTION

A flat panel display is provided, which includes a transceiver including a transmitter transmitting a data including at least two bits during one clock period as a current having a predetermined magnitude and a predetermined direction depending on bit values of the data and a receiver recovering the data from the current with the predetermined magnitude and the predetermined direction.

A flat panel display according to an embodiment of the present invention includes: a transmitter including a first current source producing a first current, a second current source producing a second current, a first switching circuit for supplying the second current to the first current to form a third current depending on a value of a lower bit of an input data, and a second switching circuit for determining a direction of the third current depending on a value of an upper bit of the input data and generating a signal based on a magnitude and the direction of the third current; a transmission line transmitting the signal from the transmitter; and a receiver including a termination resistor having first and second ends connected to the transmission line and an output circuit for generating an output data based on voltages at the first and the second ends of the termination resistor.

Each of the first and the second switching circuits preferably includes at least one MOS transistor.

An exemplary second switching circuit includes first and second groups of transistors provided with the third current and connected in parallel, the transistors in each group are connected in series, and the transistors of each of the first and the second groups are connected to the transmission line and applied with values different from each other depending on the upper bit of the input data.

An exemplary output circuit includes: a first comparator for comparing the voltages at the first and the second ends of the termination resistor and generating a first output representing an upper bit of the output data; a second comparator for comparing the voltage at the first end of the termination resistor and a predetermined reference voltage; a third comparator for comparing the voltage at the second end of the termination resistor and a predetermined reference voltage; and an OR gate for ORing outputs of the second and the third comparators and generating a second output representing a lower bit of the output data.

A flat panel display according to another embodiment of the present invention includes: a transmitter including a current source generating a reference current, a first transistor connected to the current source, a plurality of current paths connected to the first transistor, and a logic circuit for determining activation of the current paths based on an input data, the plurality of current paths including first and second sets of the current paths, each current path including a mirror transistor forming a current mirror with respect to the first transistor and a switching transistor controlled by the logic circuit to activate the current path; a transmission line for transmitting currents from the transmitter, the transmission line including first and second transmission paths, the current paths in the first and the second sets of the current paths joined to form the first and the second transmission paths, respectively; and a receiver including a load circuit transforms currents from the first and the second transmission paths into first and second voltages and having a plurality of nodes and an output circuit for generating an output data based on the first and the second voltages and voltages at the nodes of the load circuit.

The load circuit preferably includes a first group of resistors connected between a predetermined voltage and the first transmission path and a second group of resistors connected between the predetermined voltage and the second transmission path, and the output circuit comprises a first comparator for comparing the first and the second voltages and generating a first output, second and third comparators for comparing the voltages at the nodes of the load circuit, and an OR gate for ORing outputs of the second and the third comparators and generating a second output forming the output data together with the first output of the first comparator.

Each of the first to third comparators has positive and negative inputs and may include a preamplifier, a comparison unit connected to the preamplifier for determining an output based on voltages on the positive and the negative inputs, and an output buffer connected to the comparison unit.

Preferably, each of the first and the second groups of resistors includes two resistors connected in series and the number of the current paths in each of the first and the second sets of the current paths is two.

A flat panel display according to another embodiment of the present invention includes: a transmitter including a first current source for forming a plurality of first current paths with respective predetermined reference currents and a plurality of transistors respectively connected to the corresponding current paths for controlling activation of the current paths depending on an input data; a transmission line for transmitting a current in a transmission path, the current paths joined together to form the transmission path; and a receiver including a second current source for forming a plurality of second current paths with respective predetermined reference currents, a plurality of transistors for transmitting the current from the transmission line to the respective current paths, and a logic circuit for generating an output based on differences between the reference currents in the second current paths and the current from the transmission line.

The first current source of the transmitter preferably includes a first PMOS transistor and a NMOS transistor connected in series between a power supply voltage and a ground and having common gates, and a plurality of PMOS transistors forming a current mirror together with the first PMOS transistor and forming the first current paths.

Preferably, the number of the first current paths is two and the number of the second current paths is three. The ratio of values of the predetermined reference currents of the two first current paths and the three second current paths is 1:2:0.5:1.5:2 in sequence.

Alternatively, the number of the first current paths is three and the number of the second current paths is seven.

A flat panel display according to another embodiment of the present invention includes: a transmitter circuit for transmitting a digital data, the transmitter circuit including a current source and a current sink for generating a current having a direction and a magnitude determined by an upper bit and a lower bit of the digital data; a load resistor provided with the current from the transmitter circuit and having first and second ends; and a receiver circuit for recovering the digital data by detecting voltages at the first and the second ends of the load resistor, the receiver circuit including a direction determining circuit for determining the direction of the current in the load resistor from polarity of a voltage difference between the first and the second ends of the load resistor and a magnitude determining circuit for determining the magnitude of the current in the load resistor from a magnitude of the voltage difference.

The current source and the current sink preferably includes a plurality of transistors, and, preferably, the transmitter circuit further includes a first transistor circuit for changing the direction of the current applied to the load resistor depending on the upper bit of the digital data and a second transistor circuit for changing the magnitude of the current applied to the load resistor depending on the lower bit of the digital data. An exemplary second transistor circuit is connected to the current sink.

Preferably, the direction determining circuit includes a self-biased differential amplifier including a plurality of transistors for recovering the upper bit of the digital data from the direction of the current in the load resistor, and the magnitude determining circuit comprises a comparator for recovering the lower bit of the digital data from the magnitude of the current in the load resistor. The receiver circuit preferably further includes a buffer connected to an output of the differential amplifier for controlling timing of the output of the differential amplifier in coincidence with an output of the comparator.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein:

FIG. 15 is a table illustrating the operation of the circuit shown in FIG. 14;

DETAILED DESCRIPTION OF THE INVENTION

The present invention now will be described more fully hereinafter with reference to the accompanying drawings, in which preferred embodiments of the inventions invention are shown. The present invention may, however, be embodied in many different forms and should not be construed as limited to the embodiments set forth herein.

Now, preferred embodiments of the present invention will be described in detail with reference to the accompanying drawings.

First, a digital data transceiver circuit according to an embodiment of the present invention will be described with reference to FIGS. 1 to 5.

Figures 1, 2:
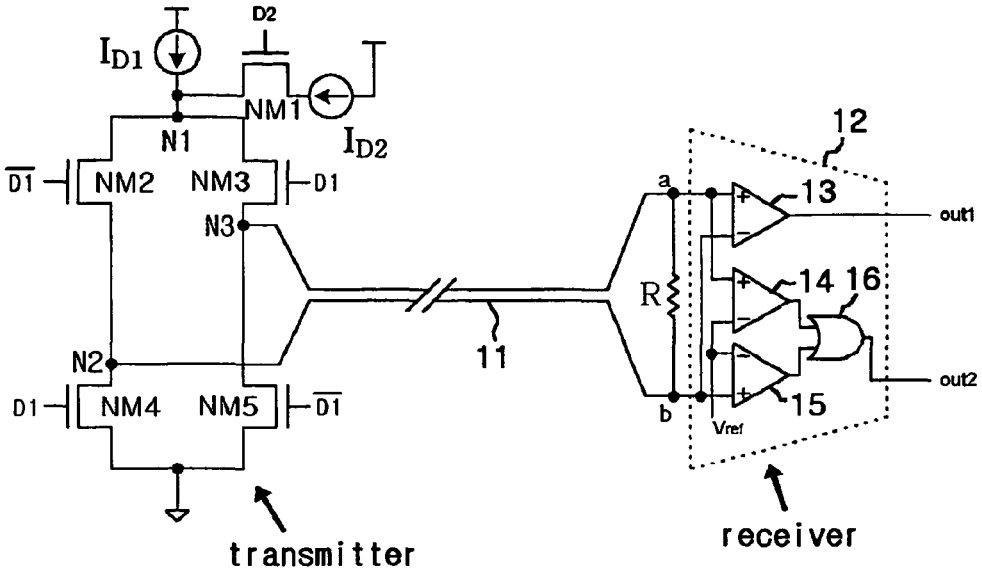
FIG. 1 shows a digital data transceiver circuit according to an embodiment of the present invention.
FIG. 2 is a table illustrating the operation of the transceiver circuit shown in FIG. 1.

A digital data transceiver circuit shown in FIG. 1 is a modification of a conventional LVDS, which transmits 2-bit data during one clock period.

As shown in FIG. 1, the digital data transceiver circuit according to this embodiment includes a transmitter, a receiver, and transmission lines 11 connecting the transmitter and the receiver.

The transmitter includes a current source unit including a pair of current sources, e.g., a first current source $I_{D1}$ and a second current source $I_{D2}$, which is connected to a switching element, such as an NMOS transistor NM1 (hereinafter, the second current source $I_{D2}$ and the switching element NM1 will be collectively referred to as a "current supplying unit"). The transmitter further includes a set of four switching elements (e.g., NMOS transistors) NM2-NM5 (hereinafter referred to as a first transistor/switching element NM2, a second transistor/switching element NM3, a third transistor/switching element NM4 and a fourth transistor/switching element NM5) connected to the first and second current sources $I_{D1}$ and $I_{D2}$. The transistor NM1 of the current source unit switches the current from the second current source $I_{D2}$ to be joined with the current from the first current source $I_{D1}$ in response to a lower bit D2 of input data (D1, D2). The set of four transistors NM2-NM5 is connected to a node N1 where the currents from the first and second current sources $I_{D1}$ and $I_{D2}$ join together to form an output current, and determines a current path, e.g., a direction or polarity, of the output current, described in greater detail below with reference to FIG. 2, in response to an upper bit D1 of the input data (D1, D2).

In detail, the set of the four transistors includes the first switching element NM2 and the third switching element NM4 connected in series with each other, and the second switching element NM3 and the fourth switching element NM5 connected in series with each other and in parallel with the first switching element NM2 and the third switching element NM4 between the node N1 and a predetermined voltage such as ground. Node N2, between the serially-connected first and third transistors NM2 and NM4, and node N3, between the second and fourth transistors NM3 and NM5, are connected to a respective one of the two transmission lines 11, as shown in FIG. 1.

The input data (D1, D2) are entered by two bits for one clock period, the upper bit D1 of the input data (D1, D2) is applied to the gates of the pair of the NMOS transistors NM3 and NM4, and an inverse $\overline{D1}$ of the upper bit D1 is applied to the pair of the NMOS transistors NM2 and NM5. Therefore, either the NMOS transistors NM2 and NM5 or the NMOS transistors NM3 and NM4 are simultaneously turned on based on the status of the upper bit D1. Here, it can be said that the upper bit D1 indicates the direction information of the transmitter current and the lower bit indicates the current amount information.

In the meantime, the provision of the current from the current source $I_{D2}$ is determined by turning on or off NMOS transistor NM1 which in turn determined by the status of the lower bit D2 of the input data (D1, D2).

The receiver includes a termination resistor R connected between the transmission lines 11 through nodes a and b and an output circuit 12 connected across the resistor R. The output circuit 12 includes three comparators 13, 14 and 15 and an OR gate 16. A positive input (+) and a negative input (−) of the comparator 13 are connected to the nodes a and b, respectively, a positive input (+) and a negative input (−) of the comparator 14 are connected to the node a and a reference voltage $V_{ref}$, respectively, and positive input (+) and a negative input (−) of the comparator 15 are connected to the node b and the reference voltage $V_{ref}$. The output of the comparator 13 is provided as an output OUT1 of the receiver, and the outputs of the two comparators 14 and 15 are logically summed by the OR gate 16 and provided as another output OUT2 of the receiver thereafter. The reference voltage $V_{ref}$ provided for the comparators 14 and 15 is preferably set as (power supply voltage-1.5IR).

A table shown in FIG. 2 shows the current $I_R$ flowing through the termination resistor R and the voltages Va-Vb across the termination resistor R as function of the input data (D1, D2). For example, if the input data (D1, D2) is (0, 1), the current in the termination resistor R flows from the node b to the node a and has a value $2I_D$, assumed that the currents from the current sources ID1 and ID2 have the same value $I_D$. (This assumption will be available throughout the specification.) On the contrary, if the input data (D1, D2) is (1, 0), the current in the termination resistor R flows from the node a to the node b, and has a value $I_D$.

Figure 3A:
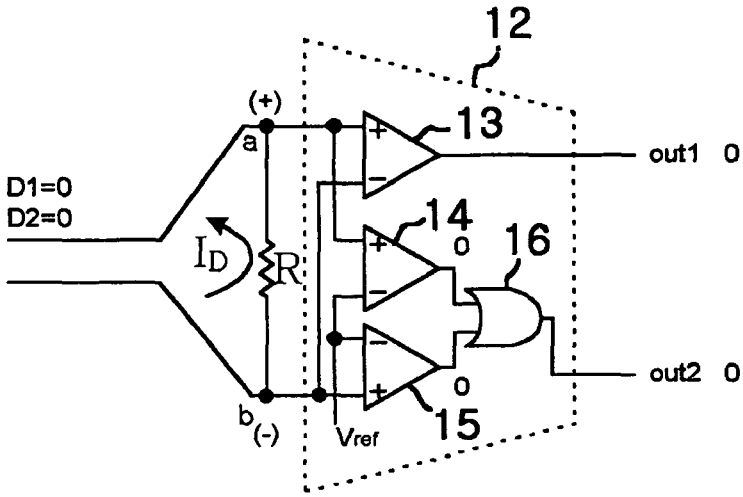
FIGS. 3A to 3D show the outputs of the receiver shown in FIG. 1 as function of the inputs.
Figure 3B:
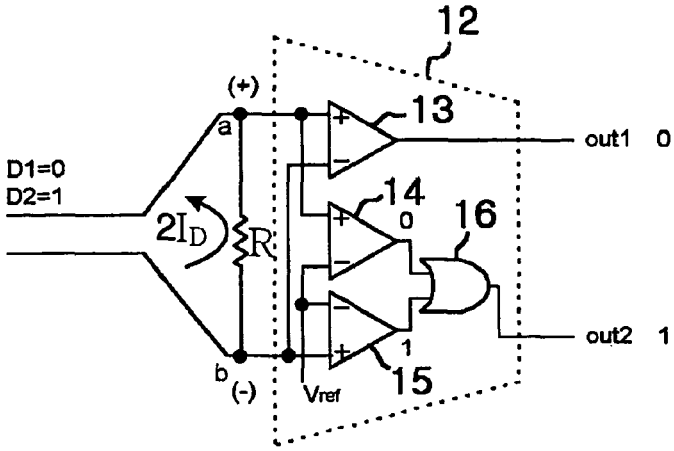
Figure 3C:
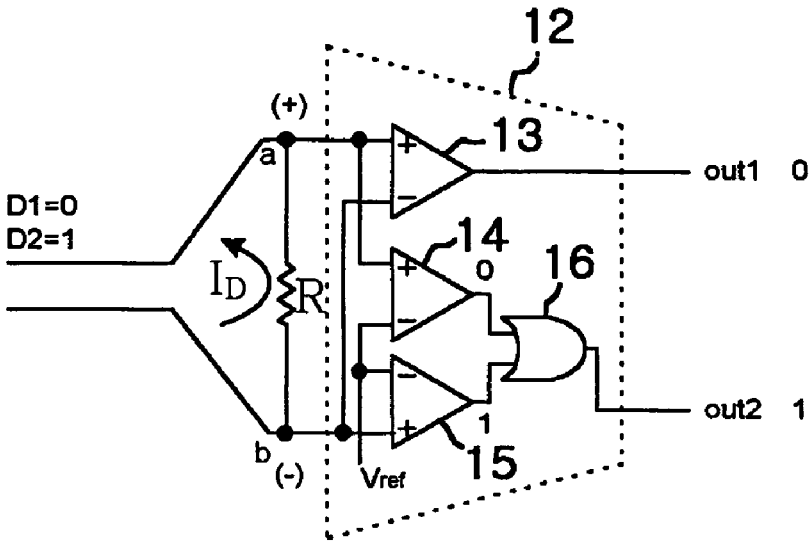
Figure 3D:
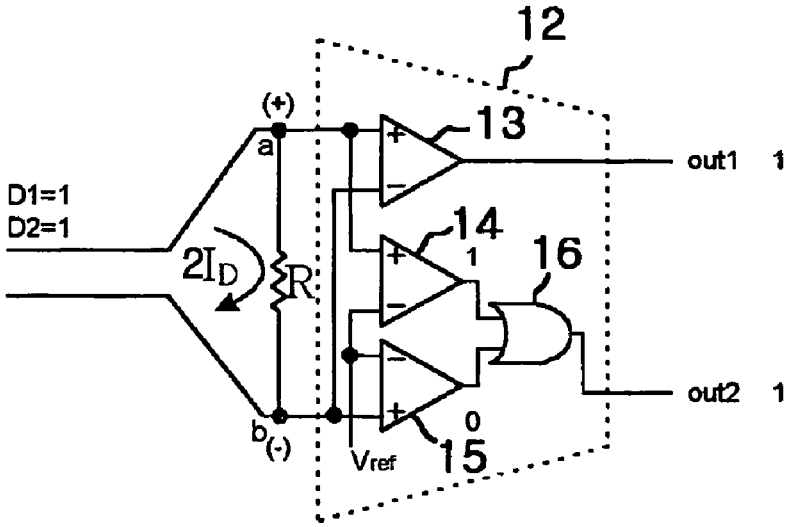

Referring FIG. 3A, when the input data (D1, D2) is (0, 0), a current having an amount of $I_D$ flows in the termination resistor R from the node b to the node a. Then, both the outputs OUT1 and OUT2 become '0'. In FIG. 3B, when the input data (D1, D2) is (0, 1), a current having an amount of $2I_D$ flows in the termination resistor R from the node b to the node a. Then, the output OUT1 becomes '0', while the output OUT2 becomes '1'. In FIG. 3C, when the input data (D1, D2) is (1, 0), a current having an amount of ID flows in the termination resistor R from the node a to the node b. Then, the output OUT1 becomes '1', while the output OUT2 becomes '0'. In FIG. 3D, when the input data (D1, D2) is (1, 1), a current having an amount of $2I_D$ flows in the termination resistor R from the node a to the node b. Then, both the outputs OUT1 and OUT2 become '1'.

Therefore, the output OUT1 of the output circuit 12 indicates the upper bit D1 of the input data (D1, D2), and the output OUT2 indicates the lower bit D2 of the input data (D1, D2). Meanwhile, the reference voltage provided for each comparator 14 or 15 is (power supply voltage-1.5IR).

Figure 4A:
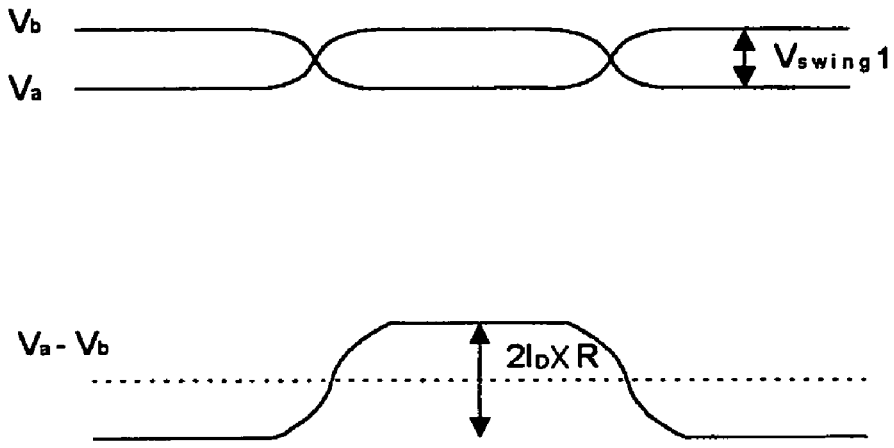
FIGS. 4A and 4B show waveforms of voltages applied to the termination resistor of the circuit shown in FIG. 1.
Figure 4B:
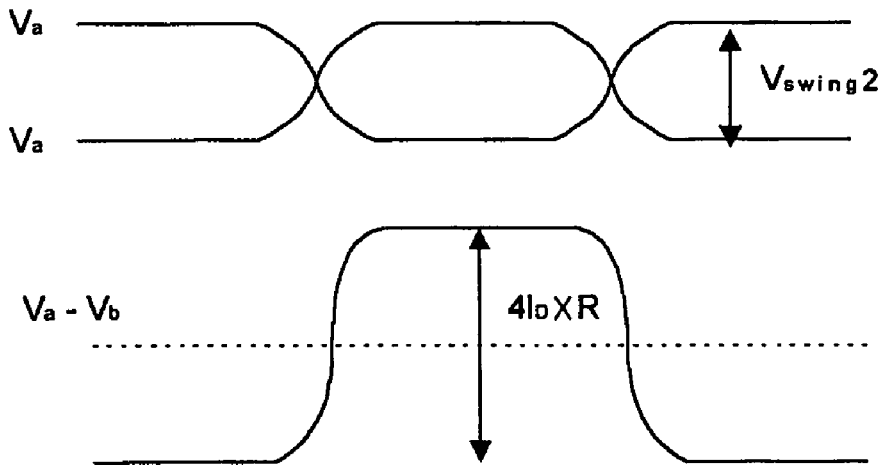

FIGS. 4A and 4B show waveforms of voltages applied to the termination resistor R. Referring to figures, the voltage swing has a maximum of $4I_DR$ depending on the input data. The maximum voltage swing is generated when the input data (D1, D2) changes from (0, 1) to (1, 1) and power consumption has also a maximum value.

FIGS. 5A to 5E illustrate simulation graphs for the signals of the circuit shown in FIG. 1. The graphs are obtained by a program HSPICE.

Figure 5A:
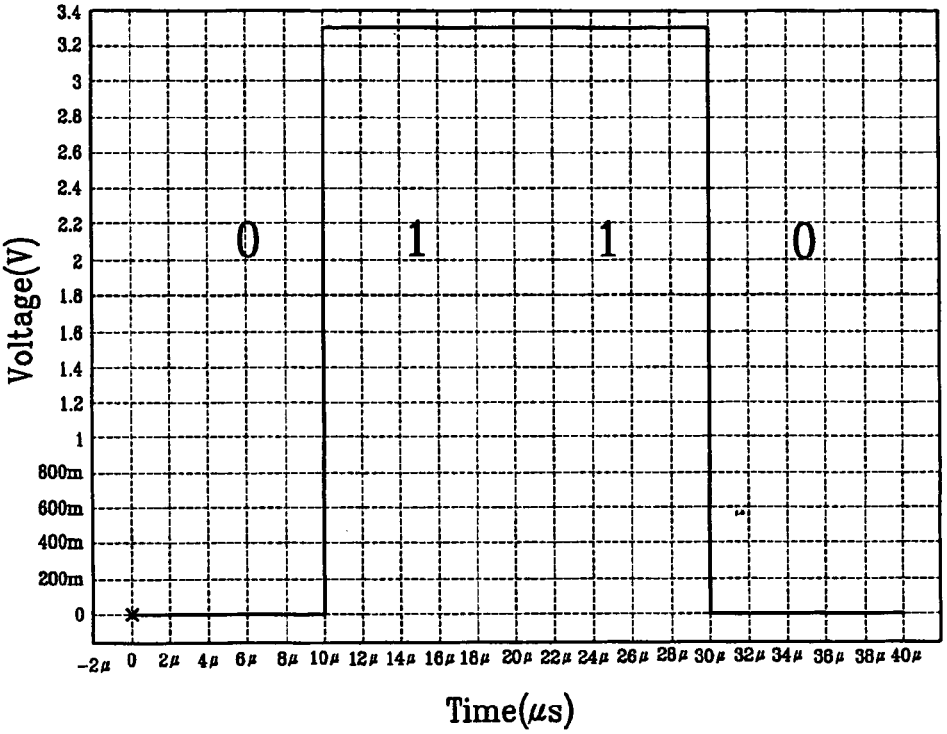
FIGS. 5A to 5E show simulation graphs for the signals of the circuit shown in FIG. 1.
Figure 5B:
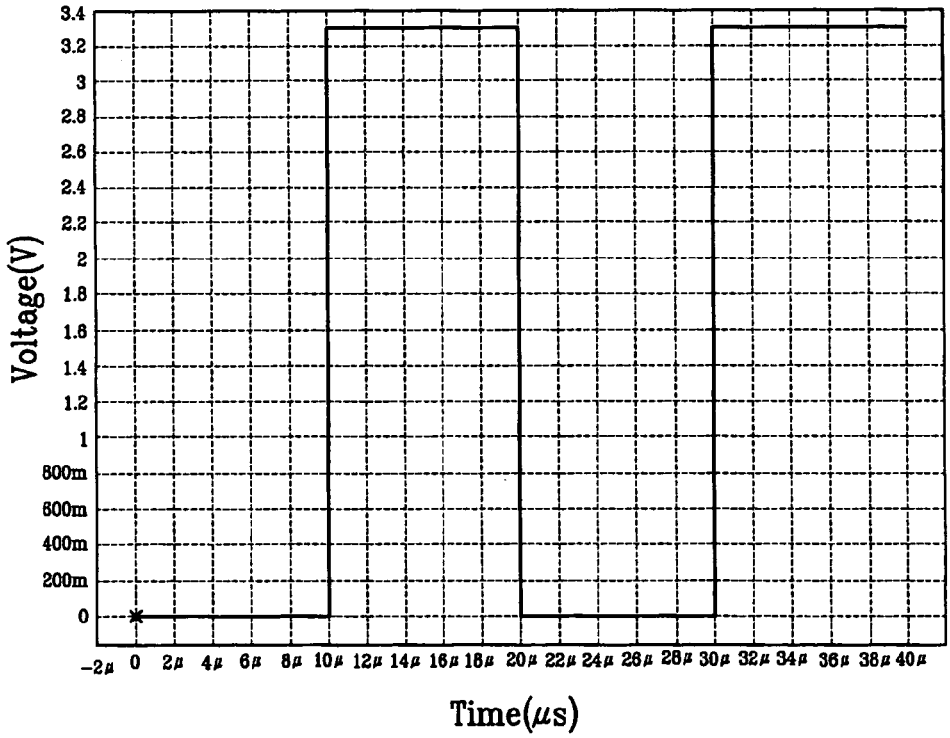
Figure 5C:
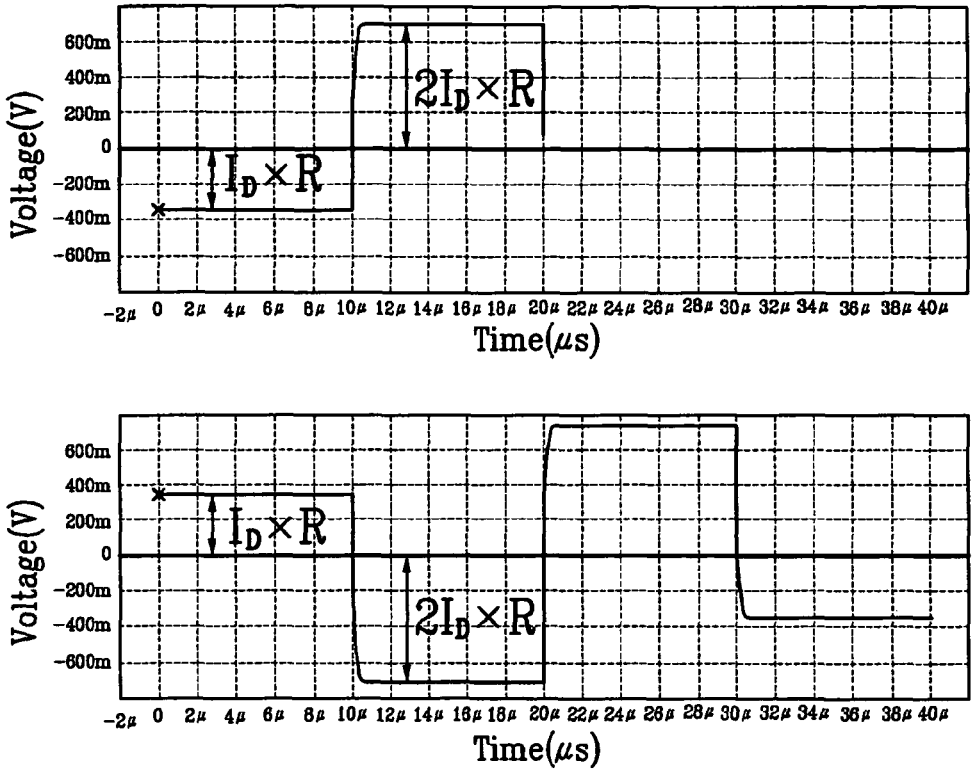
Figure 5D:
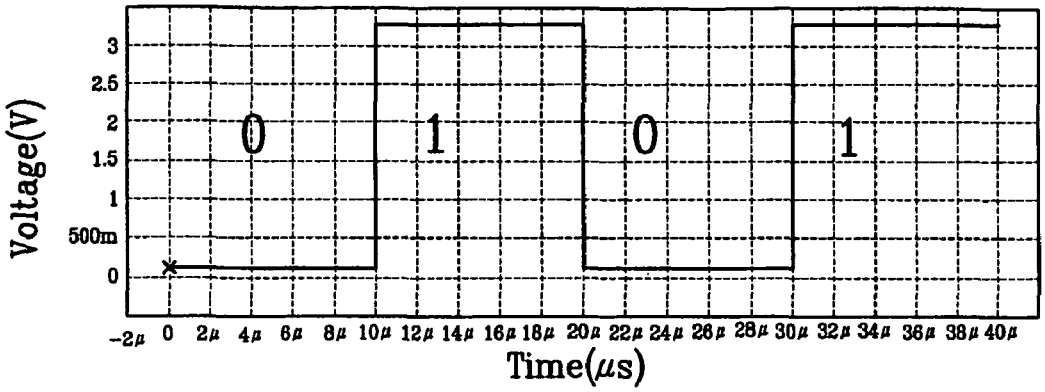
Figure 5D:
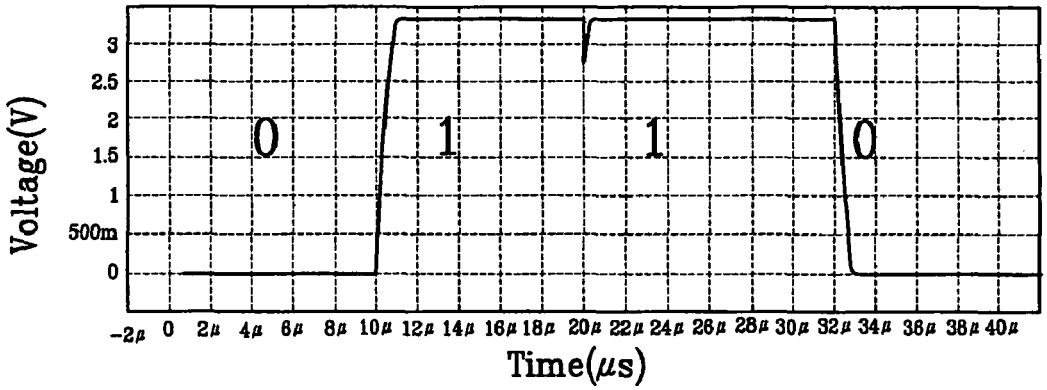
Figure 5E:
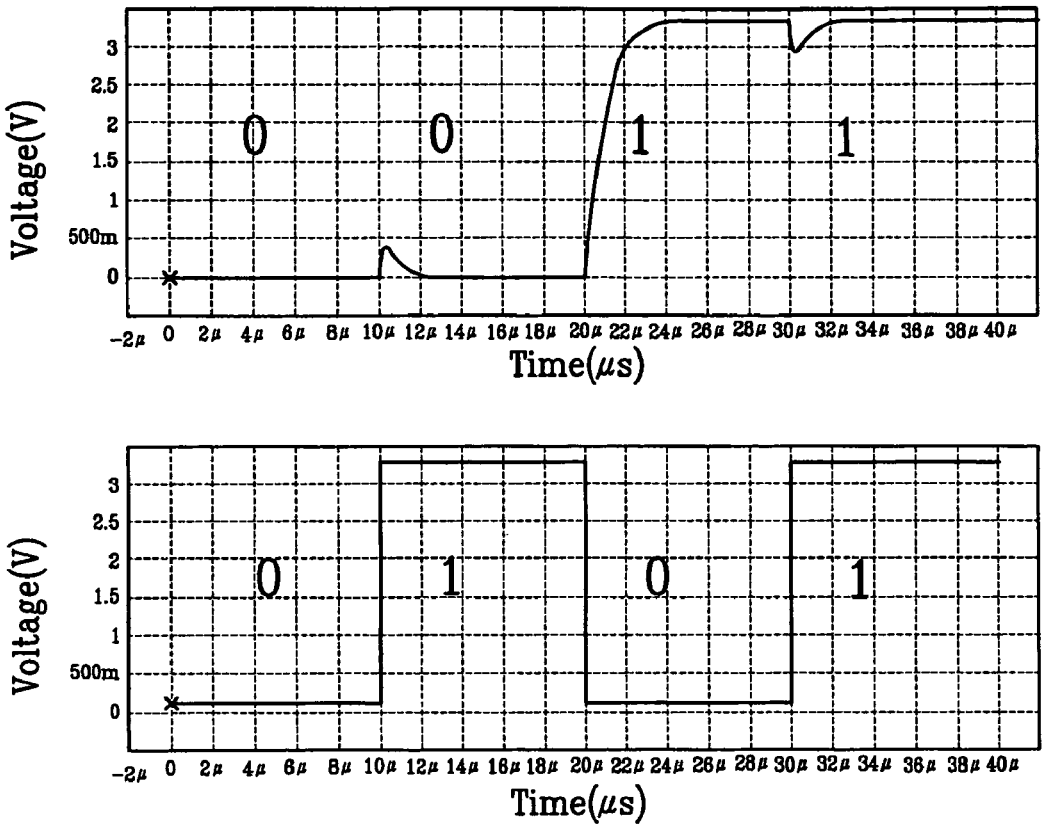

FIG. 5A shows a waveform of the upper bit D1 of the input data (D1, D2), FIG. 5B shows a waveform of the lower bit D2 of the input data, FIG. 5C shows waveforms of the voltages Va-Vb and Vb-Va across the termination resistor, FIG. 5D shows waveforms of the outputs OUT1 and OUT2 of the receiver, and FIG. 5E show waveforms of a data recovered by a decoder (not shown).

In this simulation, two current sources of 3.5 mA and a lossless transmission line having a modeled characteristic impedance of 100 and a load capacitance of 30 pF were used.

In FIG. 5E, for input data D1 (0, 1, 1, 0) and D2 (0, 1, 0, 1) in the transmitter, the recovered data of odd data (0, 0, 1, 1) and even data (0, 1, 0, 1) after performing exclusive OR operation by a decoder (not shown) in the receiver are shown. The original data supposed to transmit from the transmitter are (0,0,0,1,1,0,1,1).

Next, a digital data transceiver circuit according to another embodiment of the present invention will be described with reference to FIGS. 6 to 10.

Figures 6, 7:
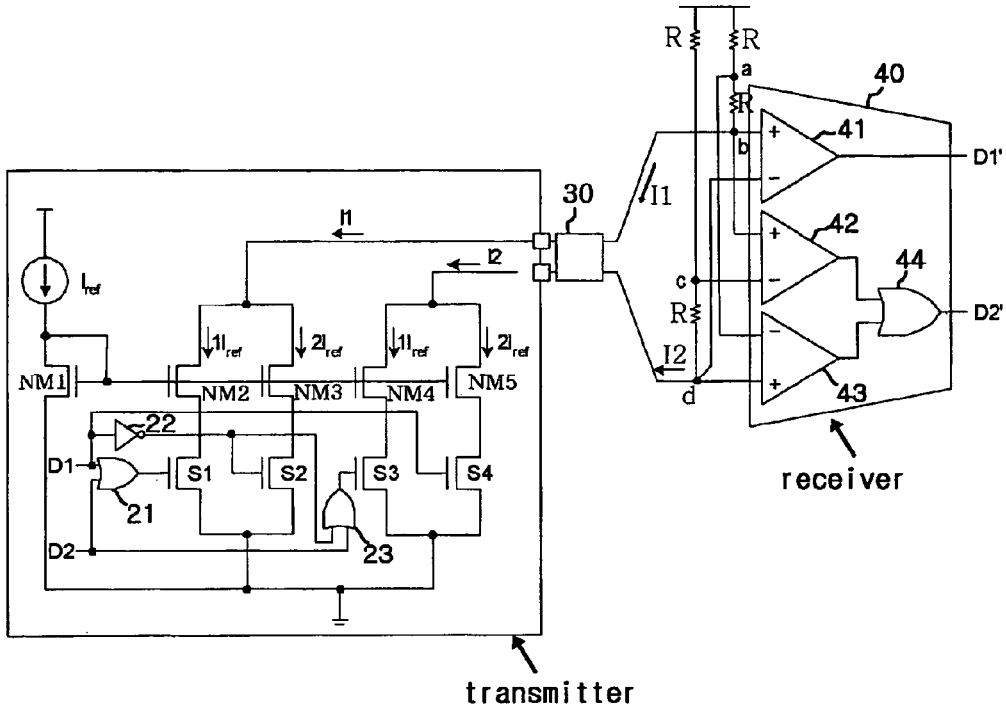
FIG. 6 shows a digital data transceiver circuit according to another embodiment of the present invention.
FIG. 7 is a table illustrating the operation of the circuit shown in FIG. 6.

A digital data transceiver circuit shown in FIG. 6 is a modification of a conventional TMDS, which transmits 2-bit data during one clock period.

As shown in FIG. 6, a digital data transceiver circuit according to this embodiment includes a transmitter, a receiver, and a transmission line 30 connecting the transmitter and the receiver. The transmission line 30 has two current paths I1 and I2.

The transmitter includes an NMOS transistor NM1, a current source generating a reference current $I_{ref}$, two pairs of NMOS transistors NM2 and NM3; and NM4 and NM5, each pair including two NMOS transistors NM2 and NM3; or NM4 and NM5 connected in parallel to the corresponding current paths I1 and I2 of the transmission line 30 and having a mirror relationship to the NMOS transistor NM1, a plurality of switching transistors S1, S2, S3 and S4 for controlling the conduction of the paths including the respective NMOS transistors NM2, NM3, NM4 and NM5, and a plurality of gates 21, 22, and 23 for determining input conditions of the switching transistors S1, S2, S3 and S4 using 2 bit input data (D1, D2).

The receiver includes a load circuit including two pairs of resistors, each pair including two resistors R connected between a supply voltage and the respective current paths I1 and I2, and an output circuit 40 outputting outputs based on the voltage value of predetermined nodes of the load circuit. The output circuit 40 includes three comparator 41, 42 and 43 and a gate 44 performing logic sum (OR) operation on the outputs of the two comparators 42 and 43. The output of the comparator 41 is provided as an output data D1' and the output of the gate 44 is provided as an output data D2'.

The transmitter of the digital data transceiver circuit according to this embodiment of the present invention controls the currents I1 and I2 flowing in the two current paths I1 and I2 of the transmission line 30 in response to the 2-bit input data (D1, D2), thereby enabling the transmission of the input data. The output data D1' and D2' of the receiver indicates the output data for the input data (D1, D2).

The currents I1 and I2 are transformed into voltages by the load circuit, and the transformed values are compared to each other. If I1 is larger than I2, then the output data D1' becomes '0', and if I1 is smaller than I2, then the output data D1' becomes '1'. In addition, the value of the output data D2' is determined by the difference between the currents I1 and I2. If the difference between the two currents I1 and I2 is $2I_{ref}$, then it becomes '1'. This means that one of the two currents I1 and I2 has a value of $3I_{ref}$. It can be known from the transmitter circuit that each of the currents I1 and I2 can have one of the values of $I_{ref}$, $2I_{ref}$ and $3I_{ref}$.

The switching transistors S1, S2, S3 and S4 of the transmitter 20 are turned on or off based on the value of the input data (D1, D2) to control the activation of the respective current paths including the corresponding NMOS transistors NM2, NM3, NM3 and NM4 configured to generate predetermined current values. As shown in FIG. 6, the NMOS transistor NM2 generates a value equal to the reference current $I_{ref}$ by the NMOS transistor NM1 and the current source, the NMOS transistor NM3 generates a value twice the reference current $I_{ref}$, the NMOS transistor NM4 generates a value equal to the reference current $I_{ref}$, and the NMOS transistor NM5 generates a value twice the reference current $I_{ref}$. Therefore, the value of the current I1 or I2 of each current path of the transmission line 30 can be $I_{ref}$, $2I_{ref}$ or $3I_{ref}$.

FIG. 7 is a table showing the on/off status of the switching transistors S1, S2, S3 and S4 and the currents I1 and I2 of the current paths of the transmission line 30 as function of the input data (D1, D2). For example, if the input data (D1, D2) is (1, 0), only the switching transistors S1 and S4 are turned on, and accordingly, the currents I1 and I2 become $I_{ref}$ and $2I_{ref}$, respectively.

FIGS. 8A to 8D show the output values of the comparators 41-43 and the OR gate 44 for respective values of the input data (D1, D2). In FIGS. 8A to 8D, the output of each comparator 41, 42 or 43 has a high level if the voltage of the positive input (+) is larger than the voltage of the negative input (−), and, if not, it has a low level.

Figure 8A:
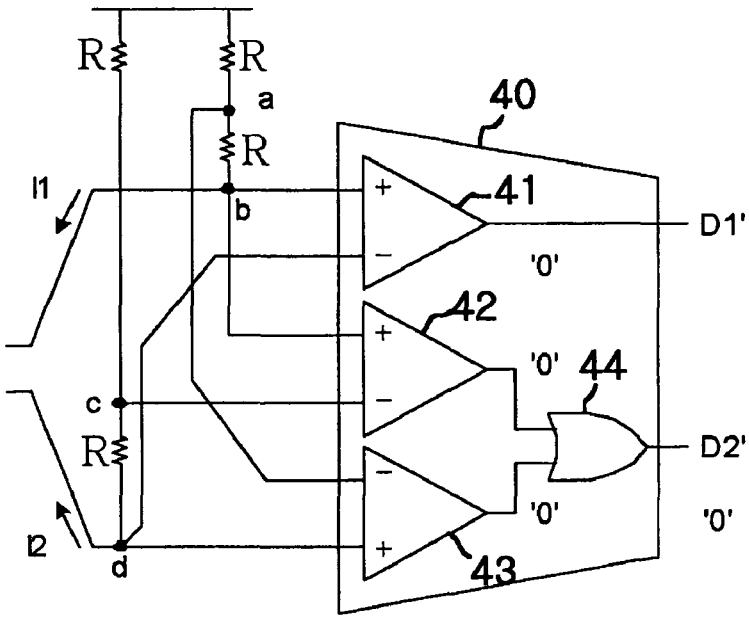
FIGS. 8A to 8D show the outputs of the receiver shown in FIG. 6 as function of the inputs.

Referring to FIG. 8A, when the input data (D1, D2) is (0, 0), $I1=2I_{ref}$ and $I2=I_{ref}$ from the table shown in FIG. 7. Then, the voltage Va at a node a becomes $Va=V_{dd}-25\times 2I_{ref}$, the voltage Vb at a node b becomes $Vb=V_{dd}-50\times 2I_{ref}$, the voltage Vc at a node c becomes $Vc=V_{dd}-25\times I_{ref}$, and the voltage Vd at a node d becomes $Vd=V_{dd}-50\times I_{ref}$, where Vdd is a power supply voltage. As a result, the output data (D1', D2') is (0, 0).

Figure 8B:
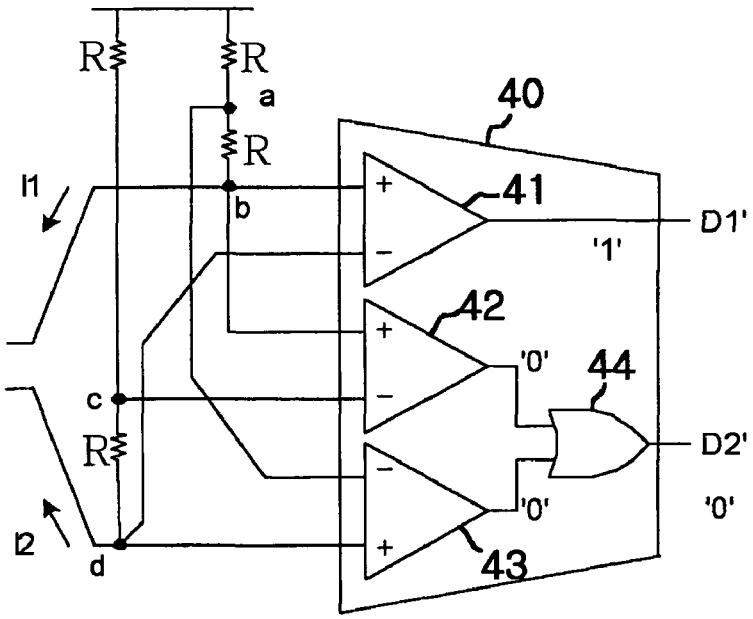

Referring to FIG. 8B, when the input data (D1, D2) is (1, 0), the output data (D1', D2') becomes (1, 0) since $I1=I_{ref}$, $I2=2I_{ref}$, $Va=V_{dd}-25\times I_{ref}$, $Vb=V_{dd}-50\times I_{ref}$, $Vc=V_{dd}-25\times 2I_{ref}$, and $Vd=V_{dd}-50\times 2I_{ref}$.

Figure 8C:
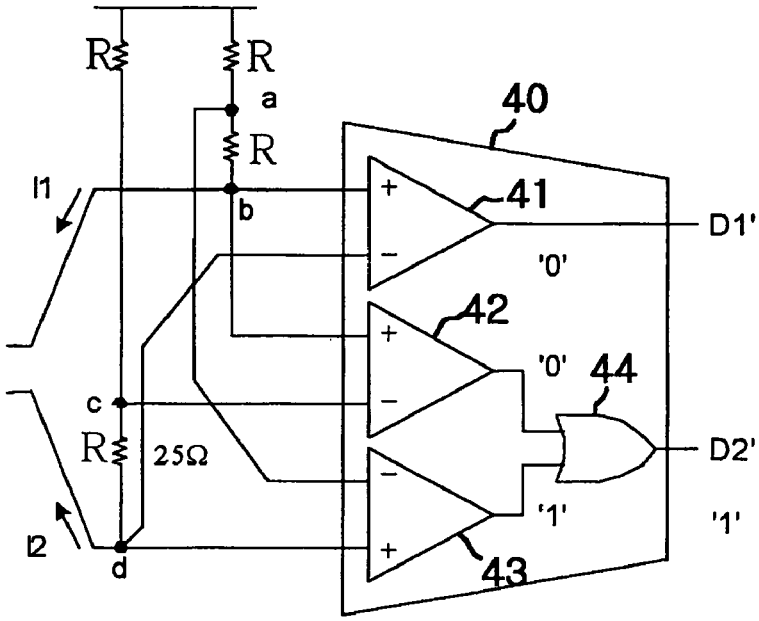

Referring to FIG. 8C, when the input data (D1, D2) is (0, 1), the output data (D1', D2') becomes (0, 1) since $I1=3I_{ref}$, $I2=3I_{ref}$, $Va=V_{dd}-25\times 3I_{ref}$, $Vb=V_{dd}-50\times 3I_{ref}$, $Vc=V_{dd}-25\times 3I_{ref}$, and $Vd=V_{dd}-50\times 3I_{ref}$.

Figure 8D:
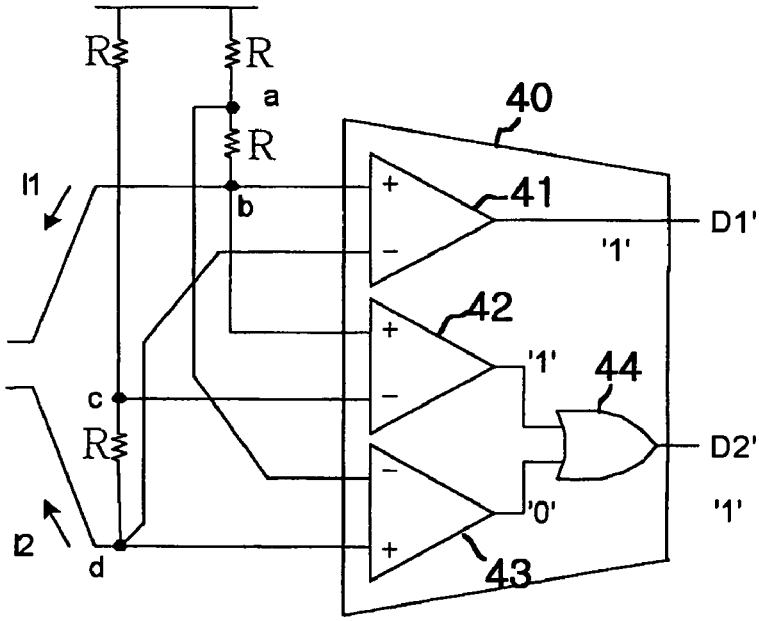

Referring to FIG. 8D, when the input data (D1, D2) is (1, 1), the output data (D1', D2') becomes (1, 1) since $I1=I_{ref}$, $I2=3I_{ref}$, $Va=V_{dd}-25\times I_{ref}$, $Vb=V_{dd}-50\times I_{ref}$, $Vc=V_{dd}-25\times 3I_{ref}$, and $Vd=V_{dd}-50\times 3I_{ref}$.

Figure 9:
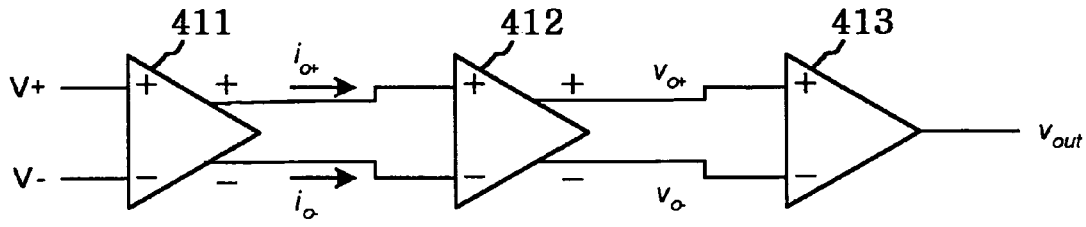
FIG. 9 is a circuit diagram showing a detailed structure of the comparators shown in FIG. 6.

FIG. 9 shows an exemplary detailed configuration of the comparator 41, 42 or 43 used in the circuit shown in FIG. 6. Referring FIG. 9, the comparator includes a preamplification unit 411, a comparison unit 412 determining an output based on the voltage values at positive and negative inputs, and an output buffer 413.

Figure 10A:
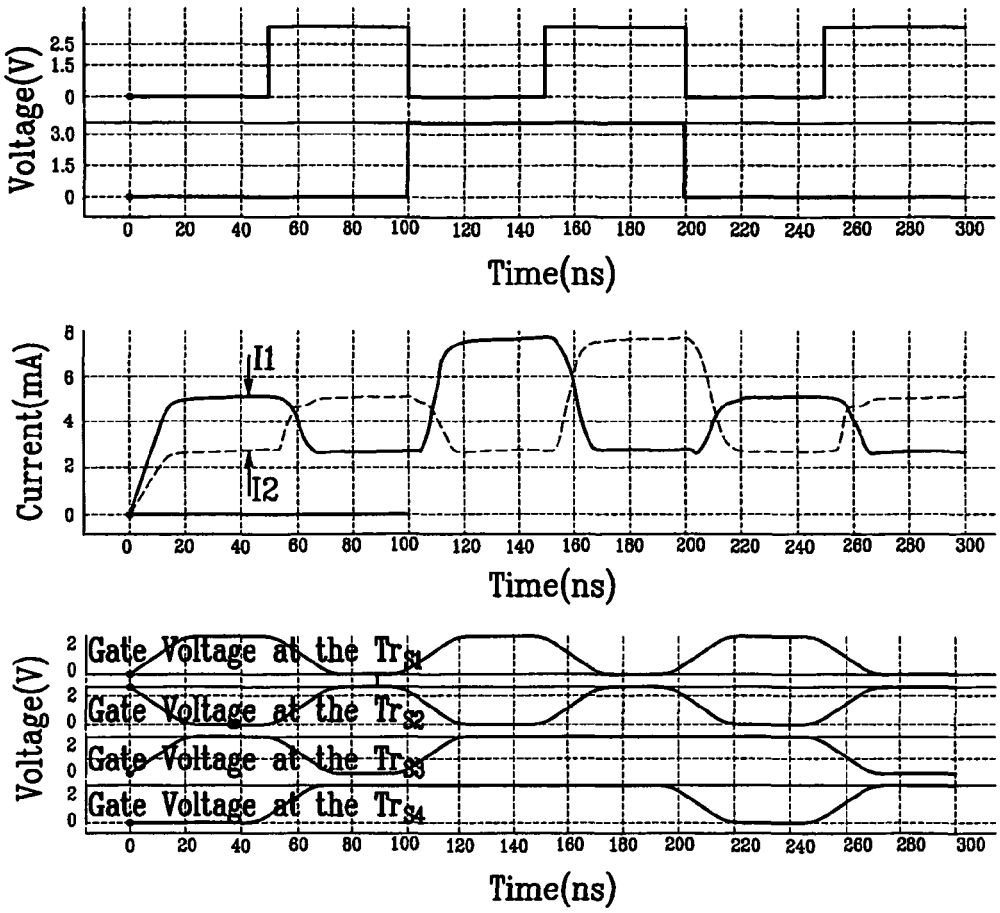
FIGS. 10A and 10B show exemplary waveforms of the signals in the digital data transceiver circuit shown in FIG. 6.
Figure 10B:
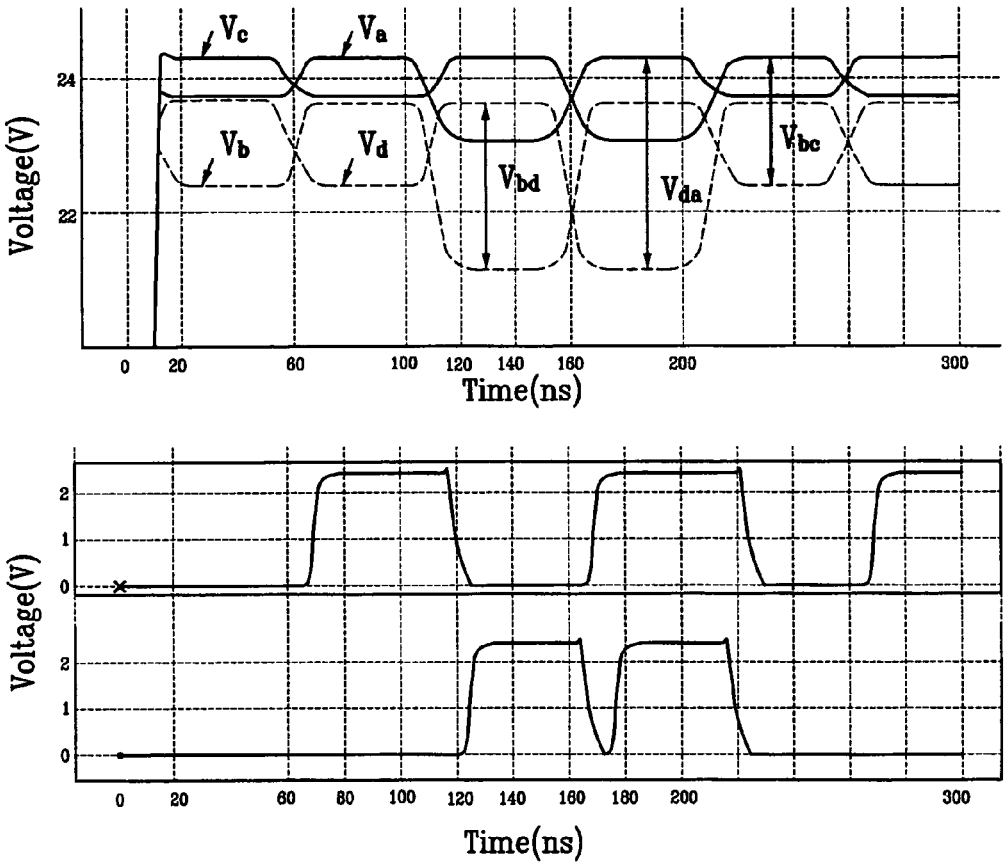

FIGS. 10A and 10B show exemplary waveforms of the signals in the digital data transceiver circuit shown in FIG. 6, which are obtained by HSPICE.

FIG. 10A shows exemplary waveforms of the input data (Din1, Din2), the gate voltages applied to the switching transistors S1, S2, S3 and S4 and the currents I1 and I2 flowing in the transmission line shown in FIG. 6. FIG. 10B shows exemplary waveforms of the node voltages Va, Vb, Vc and Vd in the load circuit of the receiver and the output data (Dout1, Dout2). The upper part of FIG. 10B shows low voltage swings between the nodes a, b, c and d. It can be seen from FIGS. 10A and 10B that the output data Dout1 and Dout2 are (0, 1, 0, 1) and (0, 0, 1, 1) for (0, 1, 0, 1) and (0, 0, 1, 1) of the input data Din1 and Din2 and the transceiver circuit according to this embodiment produces the correct result.

In this embodiment, voltage differences Vbc, Vbd, and Vba between the positive input and the negative input of the comparators have a maximum value of about $3I_{ref}\times 25$ V for the termination resistor of 25 ohms depending on the amount of the current. Here, $I_{ref}$ is 7 mA, and the characteristic impedance of the transmission line is about 100 ohms.

Next, a digital data transceiver circuit according to another embodiment of the present invention is described with reference to FIGS. 11 to 13.

Figures 11, 12:
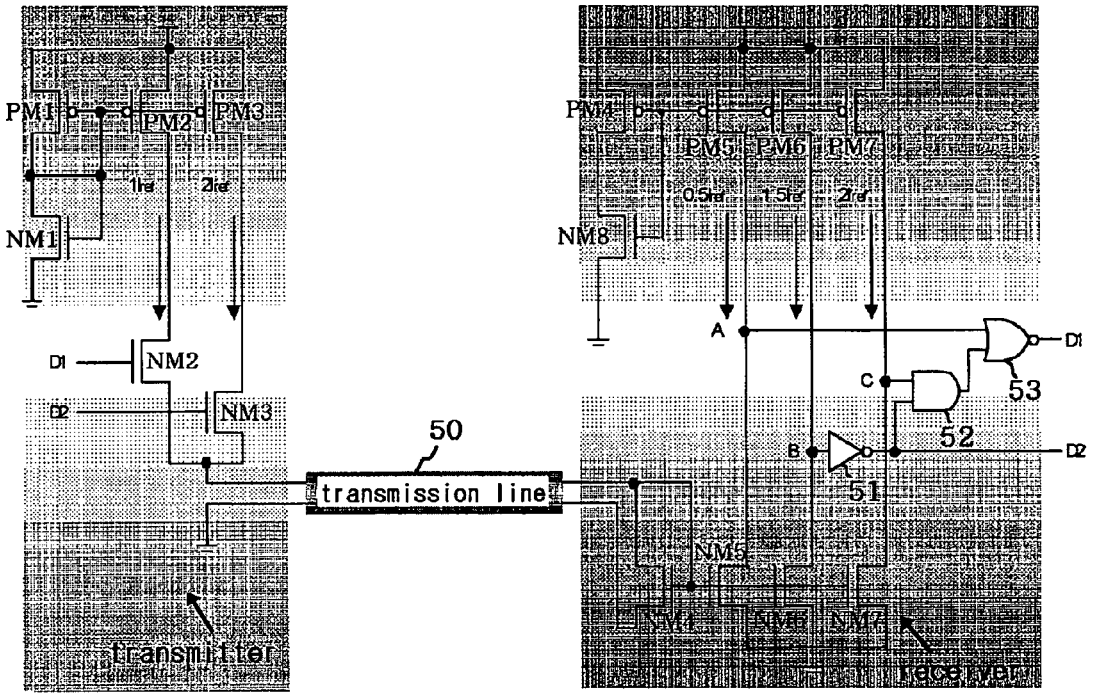
FIG. 11 shows a digital data transceiver circuit according to another embodiment of the present invention.
FIG. 12 is a table illustrating the operation of the circuit shown in FIG. 11.

A digital data transceiver circuit shown in FIG. 11 is the one using CM-MVL (Current Mode Multi-Valued Logic), which is able to transmit 2-bit data during one clock period and resistive against noise during signal transmission.

As shown in FIG. 11, the digital data transceiver circuit according to this embodiment includes a transmitter, a receiver, and a transmission line 50 connecting the transmitter and the receiver.

The transmitter 10 includes a current source having two current paths with respective predetermined currents $I_{ref}$ and $2I_{ref}$ and two NMOS transistors NM2 and NM3 connected to the two current paths for controlling the activation of the current paths based on input data (D1, D2). The current paths are joined after passing through the NMOS transistors NM2 and NM3 and connected to the transmission line 50. The current source includes a PMOS transistor PM1 and a NMOS transistor NM1 connected in series between a power supply voltage and a ground and two PMOS transistors PM2 and PM3 configured have mirror relations to the PMOS transistor PM1 and forming the respective current paths with the currents $I_{ref}$ and $2I_{ref}$, respectively. The PMOS transistor PM1 and the NMOS transistor NM1 has gates connected to each other.

The receiver includes a current source forming three current paths with $0.5I_{ref}$, $1.5I_{ref}$ and $2I_{ref}$, respectively, a plurality of transistors NM4, NM5, NM6 and NM7 for transmitting the current from the transmission line 50 to the three current paths, and three gates 51, 52 and 53 for detecting output data according to the differences in the currents between the three current paths. The three gates 51-53 includes an inverter 51 for inverting a signal at a node B and providing as an output data, an AND gate 52 for performing logical multiplication of the output of the inverter 51 and a signal at a node C, and a NOR gate 53 for performing NOR operation on the output of the AND gate 52 and a signal at a node A and provides the resultant signal as output data.

The digital data transceiver circuit shown in FIG. 11 is driven with low power consumption because it generates the currents using the combination of the MOS transistors without a separate current source and consumes the power only upon the turning on and off of the MOS transistors NM2 and NM3 in response to the input data. In addition, the digital data transceiver circuit according to this embodiment of the present invention generates the output data by detecting the differences, using the logic gates, between the predetermined currents of the three current paths and the current from the transmission line.

Since the MOS transistors perceive the voltage higher than 2.5 V as a high level and that lower than 2.5 V as a low level by their characteristics, the transmission rate of the circuit increases. Also, the circuit adopting the current transmission is strongly resistive against a noise generated during data transmission.

FIG. 12 shows signal values of the nodes A, B and C and output values of the logic gates of the receiver shown in FIG. 11 for the input data (D1, D2). In FIG. 12, Inverter1 indicates the output of the inverter 51, and Inverter2 indicates the output of the NOR gate 53.

Figure 13:
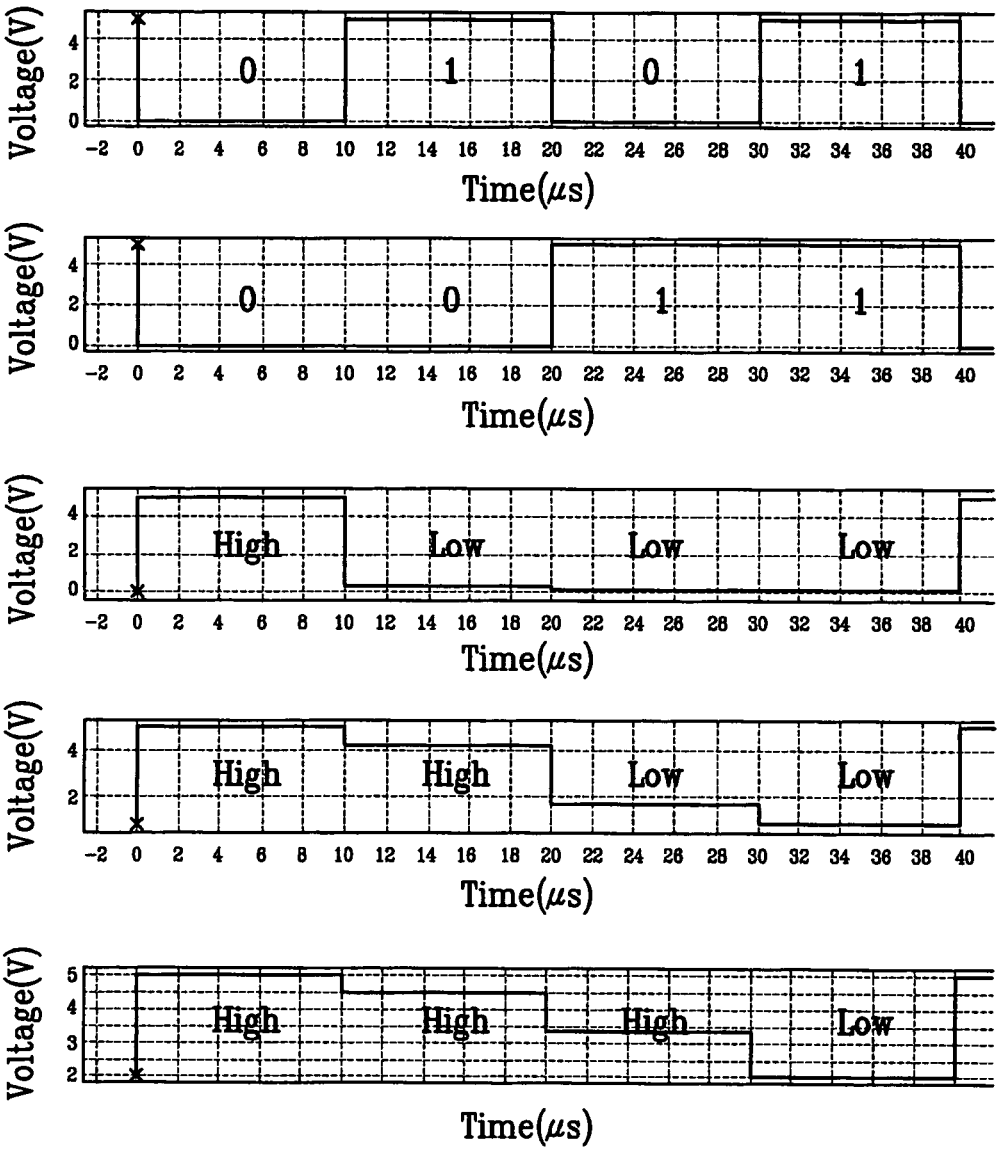
FIG. 13 shows exemplary waveforms of the signals in the digital data transceiver circuit shown in FIG. 11.

FIG. 13 shows exemplary waveforms of the input data (D1, D2) and the signals at the nodes A, B and C of the digital data transceiver circuit shown in FIG. 11 for the input data (D1, D2) given as (0,0), (1,0), (0,1) and (1,1), which are obtained by SPICE.

Next, a digital data transceiver circuit according to another embodiment of the present invention is described with reference to FIGS. 14 to 18.

A digital data transceiver circuit according to this embodiment of the present invention is able to transmit 3-bit data during one clock period, which can be obtained by modifying the transceiver circuit shown in FIG. 11.

Figure 14:
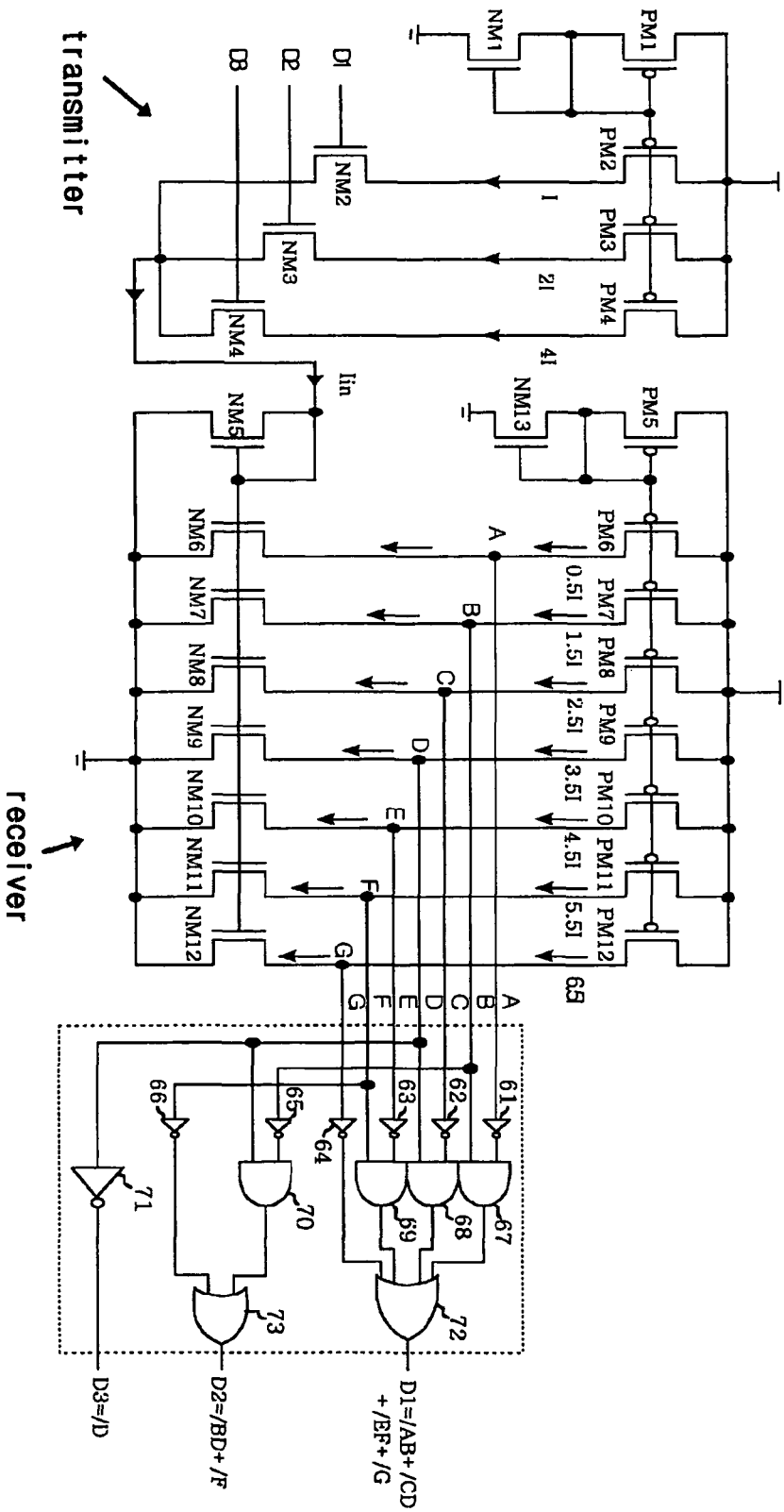
FIG. 14 shows a digital data transceiver circuit according to another embodiment of the present invention.

As shown in FIG. 14, the digital data transceiver circuit according to this embodiment includes a transmitter, a transmission line, and a receiver.

The transmitter includes a current source having three current paths with respective predetermined currents I, 2I and 4I and three NMOS transistors NM2, NM3 and NM4 which are connected to the respective current paths for controlling the activation of the corresponding current paths, based on input data (D1, D2, D3). The current paths are joined to the transmission line (indicated by 'Iin' in the figure). The current source includes a PMOS transistor PM1 and a NMOS transistor NM1 connected in series between a power supply voltage and a ground and three PMOS transistors PM2, PM3 and PM4 configured to have a mirror relation to the PMOS transistor PM1 and forming the three current paths with the respective currents I, 2I and 4I. The PMOS transistor PM1 and the NMOS transistor NM1 has gates connected to each other. Sources of the PMOS transistors PM2, PM3 and PM4 are connected to drains of the NMOS transistors NM2, NM3 and NM4, respectively, and sources of the NMOS transistors are commonly connected to the transmission line.

The receiver includes a current source forming seven current paths having 0.5I, 1.5I, 2.5I, 3.5I, 4.5I, 5.5I and 6.5I, respectively, seven NMOS transistors NM6-NM12 for transmitting the current Iin from the transmission line to the seven current paths, and an output circuit 60 for detecting output data according to the differences in current between the seven current paths. Sources of the seven PMOS transistors PM6 to PM12 are connected to drains of the corresponding NMOS transistors NM6 to NM12 and the signals at nodes A, B, C, D, E, F and G between the PMOS transistors PM6-PM12 and the corresponding NMOS transistors NM6-NM12 are provided for the output circuit 60. In addition, a pair of a PMOS transistor PM5 and an NMOS transistor NM13 is connected to the PMOS transistors PM6 to PM12 to have a mirror relation.

The output circuit 60 performs predetermined logic operations the signals at the seven nodes A, B, C, D, E, F and G and generates 3-bit output data (D1, D2, D3). The output data can be expressed by $D1=\overline{A}B+\overline{C}D+\overline{E}F+\overline{G}$, $D2=\overline{B}D+\overline{F}$, and $D3=\overline{D}$, where A-G indicates the signals at the nodes A-G, respectively. The output circuit 60 includes seven inverters 61, 62, 63, 64, 65, 66 and 71 inverting the signals at the node A, C, E, G, B, F and D, respectively, four AND gates 67-70 multiply the output of the inverter 61 and the signal at the node B, the output of the inverter 62 and the signal at the node D, the output of the inverter 63 and the signal at the node F, and the output of the inverter 65 and the signal at the node D, respectively, and two OR gates 72 and 73 performing OR operations on the outputs of the three AND gates 67-69 and the inverter 64 and the outputs of the AND gate 70 and the inverter 66. The outputs of the OR gates 72 and 73 and the inverter 71 are provided as the outputs D1, D2 and D3, respectively.

The digital data transceiver circuit shown in FIG. 14 generating the currents I, 2I and 4I using the current mirror including the combination of the MOS transistors without any specific current source and provides a current with a value I to 7I for the transmission line by switching the MOS transistors NM2, NM3 and NM4 in response to the 3-bit input data (D1, D2, D3). If the reference current I is set to 0.5 mA, the current in the transmission line ranges from 0.5 mA to 3.5 mA. The digital data transceiver circuit has low power consumption because the power is consumed only when the MOS transistors are turned on/off.

The operation of the receiver of the digital data transceiver circuit shown in FIG. 14 is described in detail. The current ranging I to 7I from the transmission line is equally transmitted to the seven NMOS transistors NM6 to NM12 via the transistor NM5, which is a current mirror. In addition, currents 0.5I, 1.5I, 2.5I, 3.5I, 4.5I, 5.5I and 6.5I flow through the respective PMOS transistors PM6 to PM12 by the current mirror. The output circuit 60 compares between upper parts and lower parts of the current paths using signals on nodes A, B, C, D, E, F and G between the PMOS transistors PM6 to PM12 and the NMOS transistors NM6 to NM12, and recovers an output data from the current differences between the upper parts and the lower parts of the respective current paths.

FIG. 15 shows the levels of the signals at the nodes A, B, C, D, E, F and G of the receiver, and the values of output data (D1, D2, D3) as function of the input data (D1, D2, D3).

Figure 16:
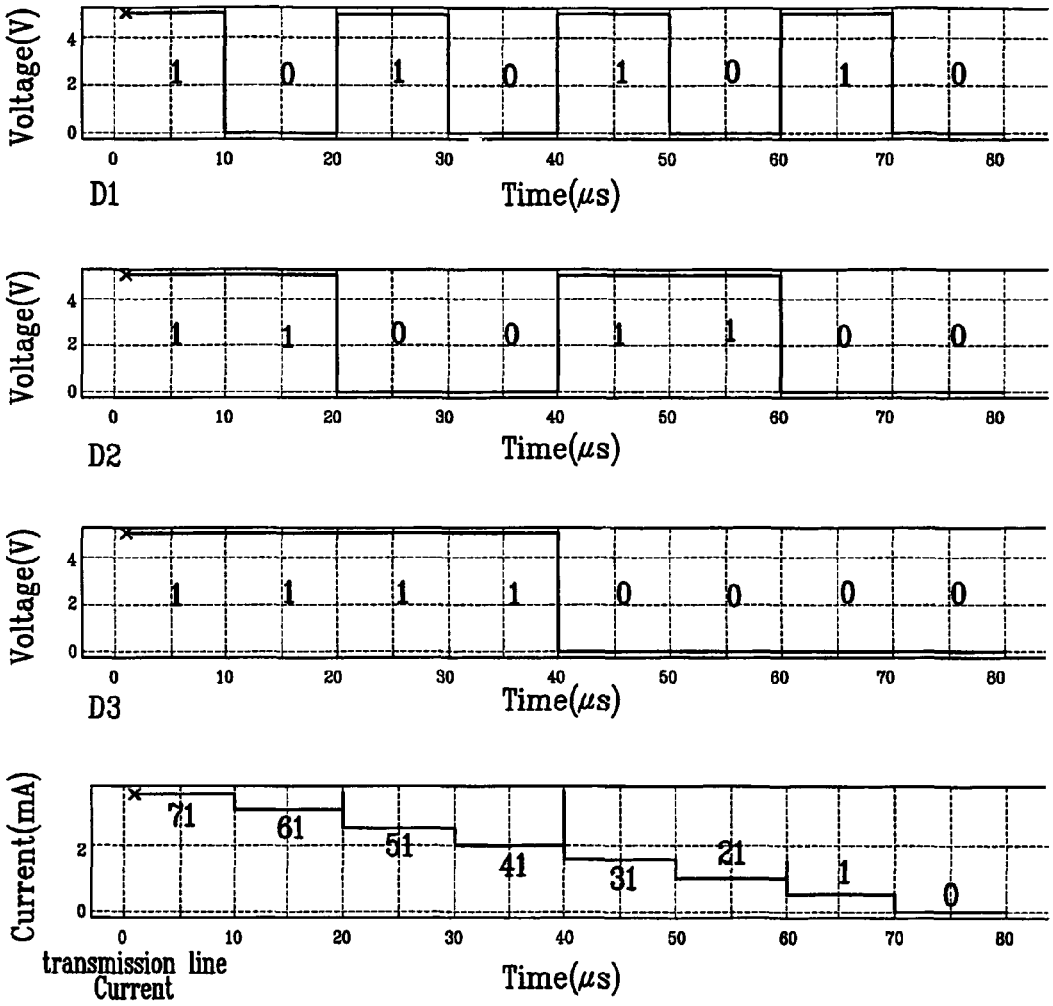
FIGS. 16 to 18 show exemplary waveforms of the signals in the digital data transceiver circuit shown in FIG. 14.
Figure 17:
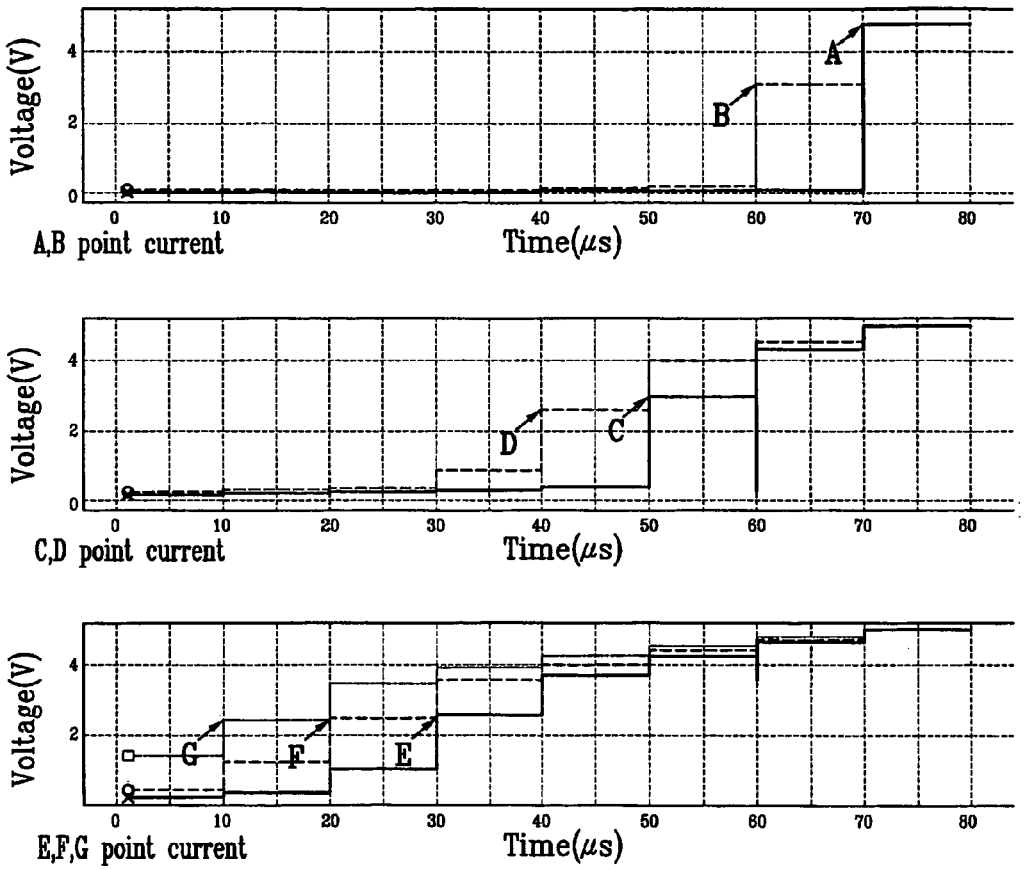
Figure 18:
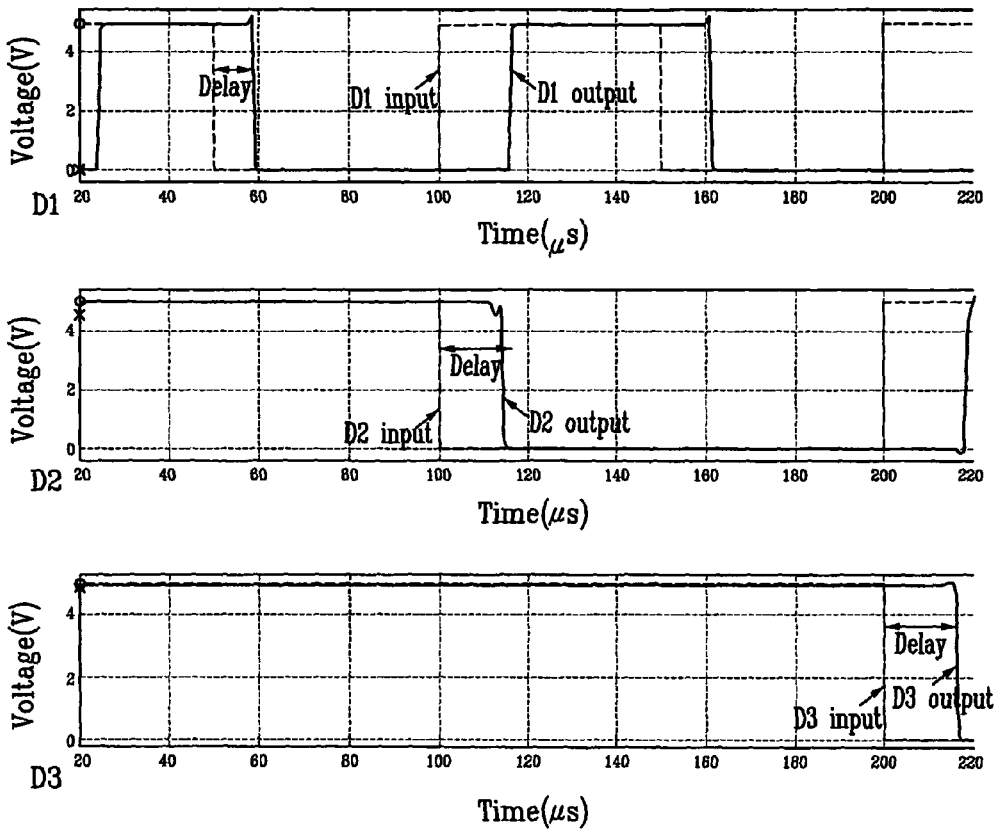

FIGS. 16 to 18 show exemplary waveforms of the signals in the digital data transceiver circuit shown in FIG. 14, which are obtained by HSPICE. The simulation was obtained under the condition that the data transmission frequency is 20 MHz and the characteristic impedance of the transmission line is 100 ohms.

FIG. 16 shows the current of the transmission line according to the 3-bit input data (D1, D2, D3).

FIG. 17 shows the voltages on the nodes A, B, C, D, E, F and G, where the voltages are expressed as 5V when the currents generated by the current mirror are larger than the current from the transmission line and as 0V in opposite case by comparing two current values.

FIG. 18 shows the input data and the output data of the digital data transceiver circuit. The signal delay was about 8 nanoseconds and a theoretical maximum data transmission frequency is about 100 MHz. However, a practical transmission frequency may not reach the theoretical value due to the characteristics of the MOS transistors. The subject of the transmission rate can be improved by optimizing the circuit configuration.

Next, a digital data transceiver circuit according to another embodiment of the present invention is described with reference to FIGS. 19 to 22.

A digital data transceiver circuit according to this embodiment of the present invention is able to transmit 2-bit data during one clock period. This embodiment is distinguished from the above-described embodiments in regard that it uses both a current source and a current sink to increase the stability of the transmission current and that it operates with a predetermined common voltage.

Figure 19:
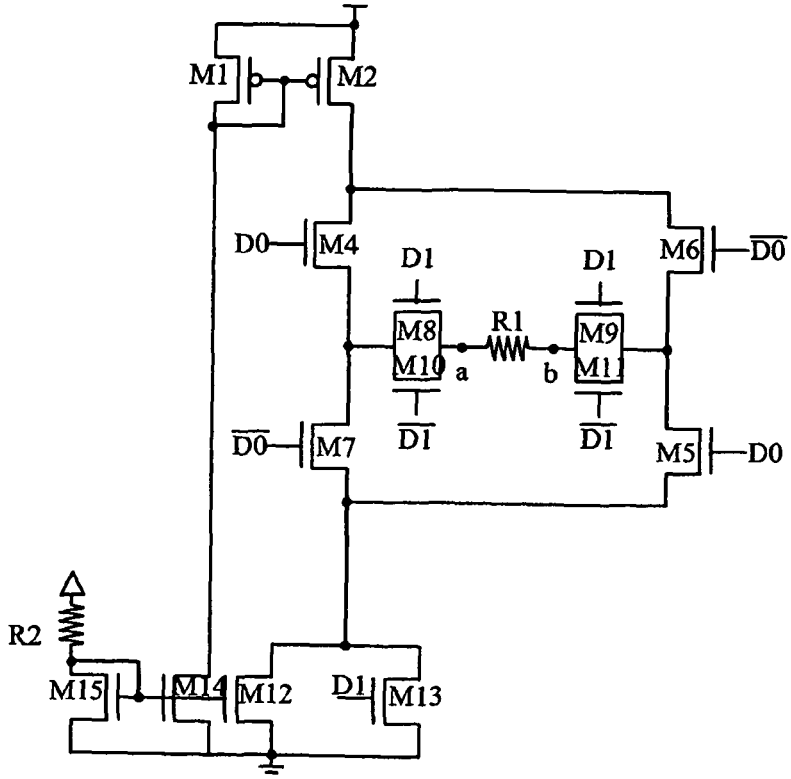
FIG. 19 shows an exemplary transmitter of a digital data transceiver circuit according to another embodiment of the present invention.
Figure 20:
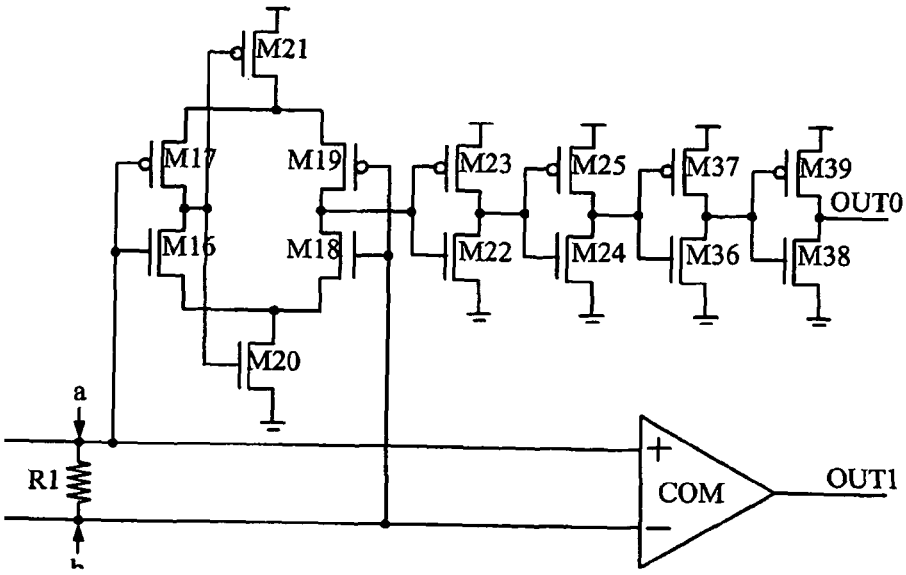
FIG. 20 shows an exemplary receiver circuit of a digital data transceiver circuit according to another embodiment of the present invention.

FIGS. 19 and 20 are an exemplary transmitter circuit and an exemplary receiver circuit of a digital data transceiver circuit according to another embodiment of the present invention, respectively. The digital data transceiver circuit according to this embodiment transmits 2-bit digital data (D0, D1) and the transmission of the data from the transmitter to the receiver is performed using current transmission. That is, the digital data to be transmitted is transformed by the transmitter into a current with an amount and a direction determined based on the digital data, and transmitted to the receiver, which recovers the digital data by detecting the amount and the direction of the received current.

As shown in FIG. 19, a transmitter of a digital data transceiver circuit according to another embodiment includes a pair of transistors M1 and M2 forming a current mirror to act as a current source, three transistors M12, M14 and M15 forming a current mirror to act as a current sink, a transistor M13 for changing the amount of the current based on a lower bit of a data to be transmitted, four transistors M4, M5, M6 and M7 for determining the direction of the current based on an upper bit of the data to be transmitted, and a load resistor R1 which functions as a transmission line.

When the operation of the digital data transceiver circuit starts, a predetermined current is generated by the transistors M1 and M2 and flows to the drain of the transistor M2. The transistors M12, M14 and M15 act as a current sink to absorb the drain current of the transistor M2. The transistor M13 turns on or off depending on the status of the lower bit D1 of the digital data to be transmitted, and the drain current of the transistor M2 increases or decreases depending on the on/off status of the transistor M13.

On the other hand, the drain current of the transistor M2 is applied to the load resistor R1 through a path determined by the transistors M4, M5, M6 and M7 depending on the status of the upper bit D0 of the data. For example, when the upper bit D0 is high level, the transistors M4 and M5 are turned on, and the transistors M6 and M7 are turned off. Therefore, the current flows from a node a to a node b across the resistor R1. Regardless of the status of the lower bit D1, one of the transistors M8 and M10 and one of the transistors M9 and M11 are turned on to form a current path. For example, the transistors M8 and M9 are turned on when the lower bit D1 is high level, while the transistors M10 and M11 are turned on when the lower bit D1 is low level. For another example, the transistors M6 and M7 are turned on when the upper bit D0 is low level, and the transistors M4 and M5 are turned off. Therefore, the current flows from the node b to the node a across the resistor R1 in this case.

Figure 21:
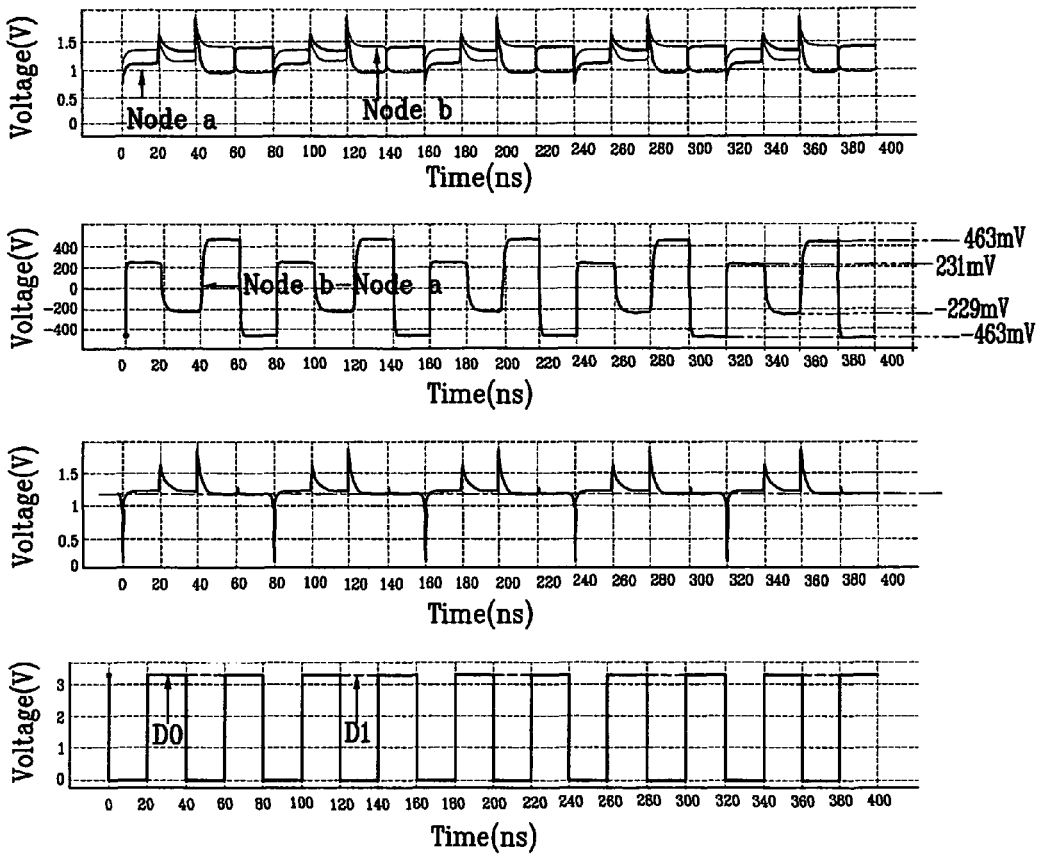
FIG. 21 shows signal waveforms at the transmitter circuit of the digital data transceiver circuit shown in FIG. 19.

FIG. 21 shows exemplary signal waveforms in the transmitter of the digital data transceiver circuit shown in FIG. 19. The uppermost waveform in FIG. 21 indicates the voltages of the node a and the node b, the next waveform indicates the voltage difference between the node a and the node b, the next waveform indicates a common voltage, and the lowermost waveform indicates a digital data (D0, D1) to be transmitted. As shown in FIG. 21, it can be known that the common voltage becomes more stable by using both the current source and the current sink in this embodiment.

As shown in FIG. 20, a receiver circuit of a digital data transceiver circuit includes a plurality of transistors M16 to M21 forming a self-biased differential amplifier, a comparator COM, and a plurality of transistors M22 to M25 and M36 to M39 forming a buffer.

The transistors M16 to M21 detects a voltage between the nodes a and b across a resistor R1 by means of amplification and determines whether it is high or low level depending on the polarity. Since the transistors M16 to M21 are self-biased, they do not need an external power supply voltage. The data obtained from the transistors M16 to M21 is provided as an upper bit OUT0 of an output data after passing through the buffer.

On the other hand, the comparator COM compares voltages at the nodes a and b across the resistor R1, and outputs a signal with a high or low level depending on the voltage difference, and the output is provided as a lower bit OUT1 of the output data.

The buffer coincides the timings of the upper bit OUT0 and the lower bit OUT1 of the output data.

As a result, the receiver circuit recovers the digital data to be transmitted from the transmitter based on the amount and the direction of the current received from the transmitter.

Figure 22:
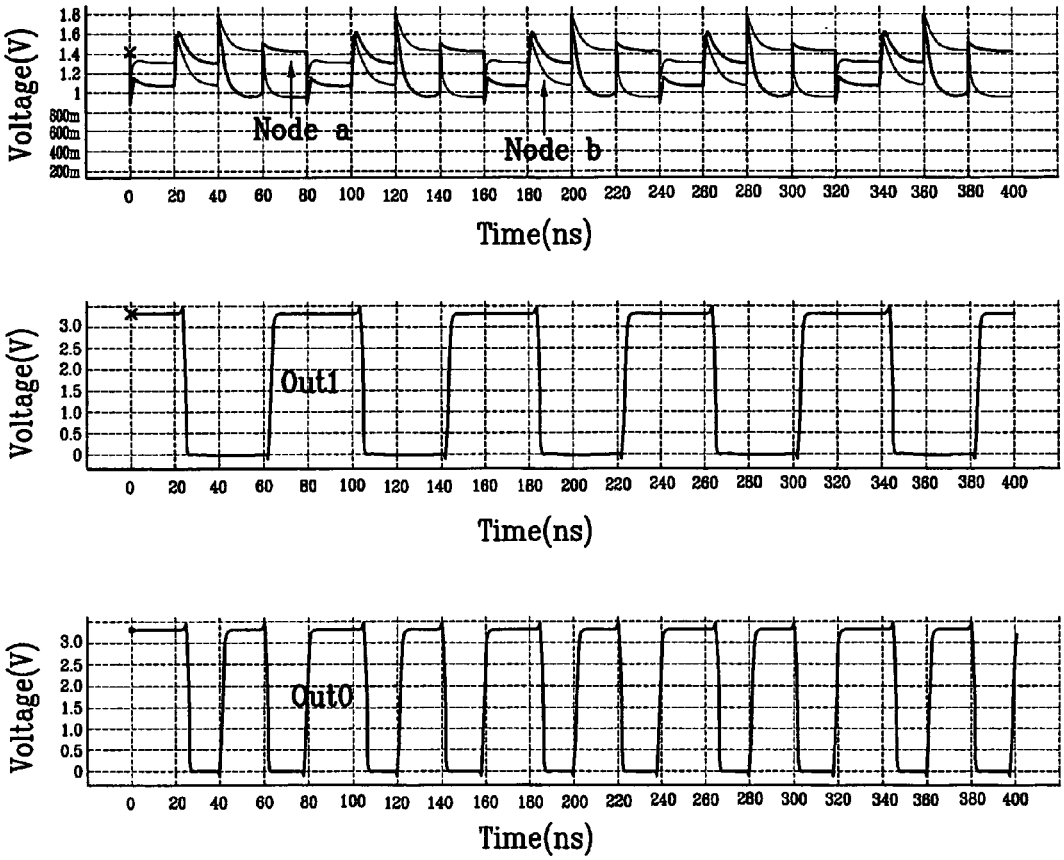
FIG. 22 shows signal waveforms at the receiver circuit of the digital data transceiver circuit shown in FIG. 20.

FIG. 22 shows exemplary waveforms of signals used in the receiver circuit shown in FIG. 20. The uppermost waveform shows voltages of the node a and the node b across the resistor R1, the middle waveform shows an output voltage of the comparator, and the lowermost waveform shows an output voltage of the buffer.

The digital data transceiver circuit according to this embodiment uniformly maintains the common voltage and enhances the stability of the transmission current using both a current source and a current sink in the transmitter. In addition, the transceiver circuit has an advantage that it does not require an external power supply voltage because it uses a self-biased differential amplifier in the receiver.

To summarize, various types of digital data transceiver circuits are described: an LVDS type transceiver circuit transmitting 2-bit data during one clock period; a TDMS type transceiver circuit transmitting 2-bit data during one clock period; and current transmission type transceiver circuits transmitting 2-bit and 3-bit data during one clock period, respectively. Since the digital data transceiver circuits according to the embodiments of the present invention transmits 2-bit or 3-bit data during one clock period, they are applicable to high-speed image transmission system of QXGA (2048× 1536) class. The current transmission type data transceiver according to the embodiments of the present invention has advantages comparing with the voltage transmission type transceiver, that it is resistible to the noise and effective to long distance transmission.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A data transceiver apparatus comprising:

a current source unit which outputs an output current, a magnitude of the output current being varied based on a value of a first bit of input data, a transmitter which comprises two output terminals and transmits the output current through the two output terminals from the current source unit in a direction defined by a value of a second bit of the input data, two transmission lines respectively connected to the two output terminals of the transmitter, and a receiver which comprises a termination resistor connected between the two transmission lines, the receiver recovers the input data based on voltages defined by the direction and a magnitude of the output current and a reference voltage, wherein the direction defined by the value of the second bit is a direction of current flowing through the termination resistor.

2. The data transceiver apparatus of claim 1, wherein the input data are inputted by two bits per one clock period.

3. The data transceiver apparatus of claim 2, wherein the first bit is a lower bit of the input data than the second bit.

4. The data transceiver apparatus of claim 3, wherein the current source unit comprises:

a first current source which outputs a first current; and a current supplying unit which is configured to output a second current to be added to the first current, wherein the current supplying unit generates the second current based on a value of the first bit, and the first current source and the current supplying unit define the magnitude of the output current based on the first current and the second current.

5. The data transceiver apparatus of claim 4, wherein the current supplying unit comprises:

a second current source which generates the second current; and a switching element, an operating state of which varies in accordance with the value of the first bit to control a magnitude of the second current.

6. The data transceiver apparatus of claim 2, wherein the transmitter comprises a plurality of switching elements, and operating states of switching elements of the plurality of switching elements are varied in accordance with the value of the second bit.

7. The data transceiver apparatus of claim 6, wherein the plurality of switching elements comprises first through fourth switching elements, wherein the first and third switching elements are connected in series with each other between the current source unit and a ground, and the second and fourth switching elements are connected in series with each other and in parallel with the first and third switching elements between the current source unit and the ground, and control terminals of the first switching element and the fourth switching element are supplied with the second bit having a first state, control terminals of the second switching element and the third switching element are supplied with the second bit having a second state, a common terminal of the first switching element and the second switching element is connected to one of the two transmission lines, and a common terminal of the third switching element and the fourth switching element is connected to another of the two transmission lines.

8. The data transceiver apparatus of claim 7, wherein the first state is inverted with respect to the second state.

9. The data transceiver apparatus of claim 2, wherein the receiver comprises:

a first comparator which compares voltages at the first and the second terminals of the termination resistor to generate an output representing the second value of the input data;

a second comparator which compares the voltage at the first terminal of the termination resistor and the reference voltage;

a third comparator which compares the voltage at the second terminal of the termination resistor and the reference voltage; and an OR gate element which ORs outputs of the second and the third comparators to generate an output representing the first value of the input data.

* * * * *